US006724984B2

(12) United States Patent
Kakuya et al.

(10) Patent No.: US 6,724,984 B2
(45) Date of Patent: Apr. 20, 2004

(54) HAIR TREATMENT PROMOTING APPARATUS WITH ROTATABLE REFLECTOR

(75) Inventors: Yuji Kakuya, Osaka (JP); Keiji Ito, Osaka (JP); Hironori Mitsui, Osaka (JP); Koji Yamane, Osaka (JP); Tomofumi Horio, Osaka (JP); Masakazu Katsumata, Osaka (JP)

(73) Assignee: Takara Belmont Corporation, Osaka (JP)

( * ) Notice: Subject to any disclaimer, the term of this patent is extended or adjusted under 35 U.S.C. 154(b) by 7 days.

(21) Appl. No.: 10/001,998

(22) Filed: Dec. 5, 2001

(65) Prior Publication Data

US 2003/0103767 A1 Jun. 5, 2003

(51) Int. Cl.[7] ..... H05B 3/00

(52) U.S. Cl. ..... 392/412; 392/415; 34/96; 34/266

(58) Field of Search ..... 392/412, 413, 392/415, 375, 376, 419; 34/96, 97, 266

(56) References Cited

U.S. PATENT DOCUMENTS

| | | | | |
|---|---|---|---|---|
| 1,440,171 A | * | 12/1922 | Papini | 392/413 |
| 2,574,621 A | * | 11/1951 | Chun | 392/375 |
| 4,691,451 A | * | 9/1987 | Giorgis | 34/68 |
| 4,910,382 A | * | 3/1990 | Kakuya et al. | 219/222 |
| 5,268,988 A | * | 12/1993 | Miyamoto et al. | 392/380 |
| 6,430,365 B1 | * | 8/2002 | Shimizu | 392/413 |
| 6,442,340 B1 | * | 8/2002 | Shimizu | 392/414 |

FOREIGN PATENT DOCUMENTS

| | | | |
|---|---|---|---|
| EP | 93824 | * | 11/1983 |
| JP | 62-184508 | * | 8/1987 |
| JP | 1-136605 | * | 5/1989 |
| JP | 4-646 | | 1/1992 |
| JP | 5-63911 | * | 3/1993 |
| JP | 10-113218 | * | 5/1998 |
| JP | 2000-152816 | * | 6/2000 |
| JP | 2000-296017 | * | 10/2000 |
| JP | 2001-29122 | * | 2/2001 |

* cited by examiner

*Primary Examiner*—John A. Jeffery
(74) *Attorney, Agent, or Firm*—Armstrong, Kratz, Quintos, Hanson & Brooks, LLP

(57) ABSTRACT

A hair treatment promoting apparatus in which a reflector provided with a heater for radiating infrared rays is rotated by a motor so that the infrared rays are radiated to the top, back and both sides of a head of a subject. The heater and reflecting plate form a heating device rotated by the motor and a disk is provided which rotates with the motor. The disk is provided with a slit for a home position and slits for stopping arranged on both sides thereof, and energization of the motor is interrupted when the slit for the home position is detected within a prescribed time elapsed from when the slit for stopping is detected in the direction of rotating the heating device, thereby stopping the heating device at the home position.

3 Claims, 18 Drawing Sheets

HAIR TREATMENT PROMOTING APPARATUS WITH ROTATABLE REFLECTOR

BACKGROUND OF THE INVENTION

1. Field of the Invention

This invention relates to an barber/beauty instrument for spraying a warm/hot wind to hair in order to promote permanent hair waving, hair dyeing, hair drying in hair washing at a barber/beauty shop, and more particularly to a hair treatment promoting apparatus for applying infrared rays to and heating the hair in the permanent hair waving, hair dyeing, hair drying in hair washing, etc. at the barber/beauty shop.

2. Description of the Related Art

Traditionally, such a barber/beauty instrument as described above was placed on a moving stand, and moved to the position where it is set at the hair of a subject whom an operator gives treatment. Inherently, in such a kind of barber/beauty instrument, a power feed code is directly wired to the barber/beauty instrument body. Particularly, the barber/beauty instrument which is rotated around the hair for uniform applying of infrared rays was attached to a ceiling, wall or moving stand.

Since the above instrument attached to the moving stand must be positioned at a nearer position to the hair, it was placed at the front position of the moving stand.

In a conventional moving stand on which the barber/beauty instrument is placed, as shown in FIG. 25, a main pole 20 is extended upright from a leg stand 21 equipped with movable casters 22. The main pole 20 is equipped with an ascending/descending rod 1 which is balanced by a spring. The rod 1 can be locked by a handle 23.

A barber/beauty instrument body 25 is attached to the moving stand structured as described above so that an applying unit 24 equipped with a rotatable heater for radiating infrared rays rotates around the hair.

An explanation will be given of the internal structure of the conventional barber/beauty instrument body 25. A stem stand 26 is placed on the ascending/descending rod 1. A bracket 27 is attached to the stem stand 26.

A driving source 28 such as a motor, a hydraulic machine, etc. is attached to the upper portion of the bracket 27. A gear 28*a* is attached to the driving source 28. The gear 28*a* is engaged with a gear 29 equipped with a rotary shaft 30.

The rotary shaft 30 is rotatably attached to a bracket via a bearing 31 therebetween. A rotary plate 33 is attached to the rotary shaft 30. An applying unit 24 equipped with a heat for applying infrared rays is attached to the rotary plate 33.

In the above configuration, when the driving source 28 is driven, the rotary shaft 30 is rotated through the gears 28*a* and 29. Thus, the applying unit 24 is rotated around the hair so that the infrared rays are uniformly applied to the hair.

As described above, in order to set the barber/beauty instrument unit 25 at the position close to the hair, the applying unit 24 having the heater is located at the front of the moving stand. In addition, the main components such as the driving source 28 and the applying unit 24 are incorporated at the top in the body 25 so that the barber/beauty instrument has a top-heavy structure with the center of gravity at a forward position.

As understood from the above description, the barber/beauty instrument which is relatively heavy is placed on the moving stand. Since the barber/beauty instrument must be located in the vicinity of the hair of the subject, it is located at the forward potion of the moving stand. This may present a problem that when the instrument is moved, if there is a protrusion on a floor, the moving stand may fall down owing to the protrusion; and when the head of the barber/beauty instrument body is moved by pushing, the weight is applied to the top so that it is placed in an unstable state.

A prior art of the hair treatment promoting apparatus is disclosed in Japanese Patent Publ. No. 4-646 filed by the applicant of this application. In the hair treatment promoting apparatus according to this prior art in which a reflector equipped with a heat for radiating infrared rays is rotated so that the infrared rays are radiated along the top, rear and both sides of the head, a non-contact thermometer for detecting the hair temperature of the subject using the infrared rays from the head of the subject is provided.

In the above prior art, since the non-contact thermometer remote from the hair measures the quantity of the infrared rays radiated from the hair to detect the temperature of the hair, when the subject shakes the head to approach or leave the heater, the temperature of the heater is automatically controlled so that the hair is uniformly heated. When the head approaches or leaves excessively the heater, the temperature cannot be controlled, a warning is issued by sound or light.

Meanwhile, in order to detect the temperature of the hair accurately, when the treatment is started, the hair treatment promoting apparatus equipped with the non-contact thermometer must be located in the vicinity of the head. However, it is difficult to position the thermometer accurately.

Further, as the case may be, an operator forgets that temperature control is being executed while the head temperature is measured using the non-contact thermometer because the operator cannot see the measurement by the non-contact thermometer. For safety, the heater is apt to be set slightly above the head. Therefore, the non-contact thermometer is likely to deviate from the head so that it measures a lower temperature. Accordingly, the heater will heat the head excessively.

Further, in the structure of the hair treatment promoting apparatus wherein the heater formed in a disk-shape in section is attached to a reflecting plate, the heater is passed through a glass in a doughnut shape having a slightly larger diameter than that of the heater. The outer periphery of the glass is wound with a lengthy steel wire, and the remaining steel wire is secured to an attaching hole made in the reflecting plate.

In the above prior art, since there is a gap between the heater and the glass, when the heater is rotated by the motor, contact sound of the heater and the glass is generated. When the heater is heated to a high temperature, its length becomes long by thermal expansion. As a result, metallic sound owing to the contact of the steel wire with the section of the reflecting plate is generated. Further, the insulating distance due to the distortion by the thermal expansion varies, which results in poor insulation.

In the hair treatment promoting apparatus, the reflecting plate is formed in a bowl in section. The infrared rays radiated from the heater may be concentrated partially. The reflecting plate is attached to a rotary power-feeding device for the heater in an electrically non-insulated state.

In the above prior art, the infrared rays radiated from the heater are partially concentrated so that the head of the person is heated partially. Therefore, the subject may feel partial hotness and uncomfortable. Further, the radiating efficiency is bad to take a long time to promote the hair treatment.

Further, since the reflecting plate is not electrically insulated from the rotary power-feeding device, a current flows through the reflecting plate so that if the operator touches the reflecting plate, he/she may get an electrical shock.

In the conventional hair treatment promoting apparatus, a power feeding device for passing a current through the heater is shown in FIG. 27. This power feeding device includes a brush supporting plate a which is rotated by a motor for rotating the refractor, a flat spring b which is an arched movable electrode plate with a center portion attached to the brush supporting plate a and a ring-shaped fixed electrode c which is in slidable contact with the brushes b1 which are metals for sliding bonded to both ends of the flat spring b.

Incidentally, d denotes a lead wire connected to the brush b and e denotes a lead wire connected to the fixed electrode c. It should be noted that at least two flat springs b and fixed electrodes c are provided.

In the power feeding device, when the motor is rotated in order to rotate the reflector, the flat spring b is rotated simultaneously so that the brushes b1 slides on the fixed electrode c. Thus, power is supplied from the rotary side to the fixed side so that the current is passed through the heater.

In this case, since the flat spring b is used as the movable electrode plate, when the current flows through the flat spring b, heat is generated to change a spring constant. This is a cause of poor contact during the use for a long time.

Further, if the flat spring is brought into direct sliding-contact with the fixed electrode c, its life will be shortened owing to abrasion. Therefore, the metal for sliding which is different from the flat spring b must be fixed to the flat spring using an adhesive. However, the metal for sliding may be removed from the flat spring owing to a thermal or mechanical change so that it becomes useless. Further, because the friction face is ground to be sharp, when the rotating direction of the motor is reversed, the flat spring may be broken.

Further, since it is impossible to place a rotating plane and fixed plane in a complete parallel state, the interval between the rotating plane and the fixed plane may vary while the reflector rotates. In this case, the warping of the arched flat spring b does not occur so that contact portion of the flat spring with the fixed plane comes off from the fixed plane.

In the conventional hair treatment promoting apparatus, a rotation control means has been proposed for stopping a heating device at a home position. In such a rotation control means, two slits for the home position having different widths are formed in a disk attached to a motor for rotating the heating device. Within a prescribed time from when the first slit is detected by a photo-transistor, the timing when the second slit is detected is determined as the home position where the motor is stopped.

Meanwhile, the heating device which intends to heat the subject's head uniformly is controlled so that it is rotated unidirectionally by the rotation control means. However, there is a case where heating of only the narrow area of the area is desired. In such a case, it is desired to rotate the heating device reciprocatively within a prescribed range. In such a case, the above rotation control means cannot stop the heating device at the home position.

Further, in the conventional hair treatment promoting apparatus, since the heating device including a heater may be used at a fixed state, it must be held at a stopped state. For this purpose, a motor equipped with a brake was used. No means for making reciprocative rotation (swing) of the heating device has been proposed.

In such an apparatus, when a motor starts to rotate for actuating the heating, great torque is applied to the motor. Therefore, the heating device undergoes shock and vibrates. Particularly, where the heating device is swung at regular time intervals, it vibrates owing to the shock at the time of each reversing. As a result, where the heating device is attached to the arm for suspending it from a ceiling, or to a stand equipped with casters, the heating device moves, thereby making it impossible to make appropriate hair treatment promotion.

SUMMARY OF THE INVENTION

An object of this invention is to provide a hair treatment promoting apparatus which can be made difficult to fall down by a fall-down preventing device.

Another object of this invention is to provide a hair treatment promoting apparatus which is provided with a head positioning device which permits an operator to confirm the measuring position of a non-contact thermometer visually so that an optimum initial setting can be made to control the temperature accurately, thereby realizing the hair treatment by the temperature control suitable to the hair of a subject.

Still another object of this invention is to provide a hair treatment promoting apparatus which is provided with a heater attaching structure which does not give a gap between a heater and an insulator when the heater is not energized, can absorb the length of the heater thermally expanded when it is energized, and keeps a necessary insulating distance between a reflector and the heater.

Yet another object of this invention is to provide a hair treatment promoting apparatus which is provided with a reflecting plate structure with a reflecting plate which is composed of a linear portion and a bending portion to improve the efficiency of radiation so as to improve hair treatment, and insulated from a rotation power-feeding device so that fear of getting electrical shock can be removed.

A further object of this invention is to provide a hair treatment promoting apparatus which is provided with a rotation power feeding device in which a bar-like brush of carbon is in sliding-contact with a ring-shaped electrode plate so that poor contact due to heat generation is prevented and no fear of damage occur, and asymmetrical wear of the brush can be prevented by inverting the rotation direction.

A still further object of this invention is to provide a hair treatment promoting apparatus which is provided with a rotation control device for a heating device which can accurately stop the heating device at a home position even when the heating device is rotated reciprocatively, thereby permitting partial heating, and can prevent asymmetrical wear of the rotating portion of a motor gear and a rotary power-feeding device.

A further object of this invention is to provide a hair treatment promoting apparatus which is provided with a shock reducing device when a motor is started. The shock reducing device reduces driving torque of the motor when a motor is driven and reversed, thus reducing shock when the motor is actuated so that the motor does not vibrate, and prevent movement of the heater which is attached to an arm for suspending it form a ceiling and a stand equipped with casters.

In accordance with the first aspect of this invention, there is provided a hair treatment promoting apparatus in which a reflector provided with a heater for radiating infrared rays is rotated by a motor so that the infrared rays are radiated to the top, back and both sides of a head of a subject, wherein the motor is located on an extended line of an ascending/descending rod for supporting the hair treatment promoting apparatus so that the center of gravity of the entire apparatus is located on the line.

In this configuration, since the motor which is relatively heavy is located on the axial line of the ascending/descending rod 1 attached to the main pole of the moving stand, the hair treatment promoting apparatus is held in a stable state. Therefore, even if the apparatus is caught by any protrusion on the floor when the apparatus is moved for operation, it does not easily fall down.

In accordance with the second aspect of this invention, there is provided a hair treatment promoting apparatus in which a reflector provided with a heater for radiating infrared rays is rotated by a motor so that the infrared rays are radiated to the top, back and both sides of a head of a subject, a visible light emitting device for radiating visible light is attached to a case body of the apparatus so that the visible light is radiated to a specified position of a back of the head of a subject which is determined relative to a specified position of the body case.

Preferably, the temperature at the specified position is measured by a non-contact thermometer attached to the body case.

In these configurations, since the visible light emitting device can be set at an optimum position relative to the position of the subject's head, and is positioned at the position where the hair's temperature of the subject's head can be measured by the non-contact thermometer, the light emitting device is initially set at an optimum state to make temperature control, thereby promoting the hair treatment at the temperature suited to the subject's hair.

Preferably, the visible light emitting device is provided with a light focusing means for focusing the visible light.

Since the light from the visible light emitting device is focused by a lens, the position of the emitted light can be easily recognized. This facilitates positioning of the light emitting device.

A hair treatment promoting apparatus further comprises a bar for supporting the head of the subject, the bar being brought into contact with the head to position the head.

Since the subject's head has been set using the head position supporting bar, the visible light emitting deice is positioned. Thus, the hair treatment promoting apparatus can be set accurately with improved operability.

In accordance with the third aspect of this invention, there is provided a hair treatment promoting apparatus, in which a reflecting plate provided with a heater for radiating infrared rays is rotated by a motor so that the infrared rays are radiated to the top, back and both sides of a head of a subject, wherein the heater is elastically sandwiched by divided two segments of an insulator, and the insulator attached to the reflecting plate so that it is displayable in the longitudinal direction.

In this configuration, the heater attaching structure is provided in which the heater is elastically sandwiched by the two insulator segments which is attached so as to be displaceable for the reflecting plate in the longitudinal direction. Because of such a configuration, even when the heater is increased in width and length owing to thermal expansion, the increase can be absorbed. Therefore, the thermal expansion of the heater does not give deformation to the reflector, and metallic friction sound is not also generated.

In the hair treatment promoting apparatus, preferably, the two insulator segments are elastically sandwiched by a first flat spring with a swelling portion on its outer periphery and the insulator is secured to the reflecting plate through a second flat spring having a swelling portion orthogonal to the first flat spring. Preferably, the two insulator segments are sandwiched by a single spring wire having a swelling portion, and the spring wire has ring-shaped portions at both ends which are screwed to the reflecting plate. Further, the two insulator segments are directly screwed to the reflecting plate and an elastic member such as an oval counter-sunk screw is sandwiched between the insulator segments.

In these configurations, when the heater is not energized, since there is no gap between the heater and insulator, alien sound, which may be generated due to hand touching and thermal expansion of the heater, is prevented and the necessary insulating distance between the reflecting plate and the heat is kept.

In accordance with the fourth aspect of this invention, there is provided a hair treatment promoting apparatus, in which a reflecting plate provided with a heater for radiating infrared rays is rotated by a motor so that the infrared rays are radiated to the top, back and both sides of a head of a subject, and the reflecting plate is composed of a linear segment and a bending segment attached to a heater cover located outside.

Since the reflecting plate composed of a linear segment and a bending segment is attached to the cover so that the bending segment is located outside, the heat radiation form the heater is improved.

Preferably, the hair treatment promoting apparatus further comprises a rotary power feeding device for energizing the heater, and a ring-frame is secured to the the rotary power feeding device through an insulating cap and the reflecting plate is attached to the ring frame so that the rotary power feeding device is insulated from the reflection plate.

In this configuration, the ring-frame is secured to the rotary power feeding device through the insulating cap and the reflecting plate is attached to the ring frame. In this way, the reflecting plate is electrically insulated from the rotary power feeding device so that the operator does not get electric shock when he touches the reflecting plate.

In the hair treatment promoting apparatus, preferably, the reflecting plate is attached to the heater cover through heat-resisting resin, and the reflecting plate and the heater cover are spaced apart from each other by a prescribed distance so that the heater cover is prevented from being heated.

In this configuration, the reflecting plate is attached to the cover through the heat-resistant resin so that a suitable distance is held between the reflecting plate and the cover, thereby preventing the cover from being heated. For this reason, even when the operator and subject touch the cover, they do not burn their hand.

In accordance with the fifth aspect of this invention, there is provided a hair treatment promoting apparatus, wherein a reflecting plate is provided with a heater for radiating infrared rays is rotated by a motor so that the infrared rays are radiated to the top, back and both sides of a head of a subject, which comprises a power feeding device for energizing the heater from a fixed side power source, the power feeding device includes a plurality of spring-urged rod-like brushes and concentric ring-shaped electrodes which are individually in sliding-contact with the brushes, respectively, and one of both is connected to a power source side whereas the other thereof is connected to a heater side.

In this configuration, the power feeding device, in which the heater is energized from the power source at the fixed electrode, includes a plurality of brushes urged by springs and the ring-shaped electrode in contact with each of the brushes. Because of such a configuration, unlike the conventional power feeding device using a flat spring, the power feeding device according to this embodiment is not subjected to a change in the spring constant, displacement of the brush from the ring-shaped electrode and poor contact due to the damage of the flat spring.

In the hair treatment promoting apparatus, preferably, a single ring-shaped electrode is opposite to two or more rod-like brushes.

Where two or more rod-like brushes are arranged oppositely to the single ring-shaped electrode, even when the one brush leaves from the ring-shaped electrode, sure contact therebetween can be made, thereby realizing power feeding. The other brush can be used for the power source for the other purpose.

In the hair treatment promoting apparatus, the rotating direction of the motor is reversed at prescribed timings so that the rod-like brushes are prevented from suffering from asymmetrical wear.

Since the rotating direction of the motor is reversed at prescribed timings, the rod-like brush does not suffer from asymmetrical wear. Therefore, on the basis of the stable contact between the fixed electrode and the brush, power can be fed for the use for a long time.

In accordance with the sixth aspect of this invention, there is provided a hair treatment promoting apparatus in which a reflecting plate provided with a heater for radiating infrared rays is rotated by a motor so that the infrared rays are radiated to the top, back and both sides of a head of a subject, wherein the heater and the reflecting plate constitute a heating means rotated by the motor and a disk is provided which rotates with the motor, the disk is provided with a slit for a home position and slits for stopping arranged on both sides thereof, and energization of the motor is interrupted when the slit for the home position is detected within a prescribed time elapsed from when the slit for stopping is detected in the direction of rotating the heating device, thereby stopping the heating device at the home position.

In this configuration, the disk, which rotates synchronously with the motor for rotating the heating device including the heater and reflecting plate, is provided with the slit for the home position and the slits for stopping located on both sides thereof. In operation, energization of the motor is interrupted when the slit for the home position is detected within a prescribed time elapsed from when the slit for stopping is detected in the direction of rotating the heating device, thereby stopping the heating device at the home position. In this way, the heating device can be stopped at the home position accurately when it is rotated reciprocatively. The asymmetrical wear of the rotating portion in the motor gear and rotary power feeding device can be avoided.

In the hair treatment promoting apparatus, preferably, the slit for the home position and the slits for stopping have different widths. In this configuration, the heating device during rotation can be stopped preferably.

In the hair treatment promoting apparatus, the energization time of the motor elapsing from when the home position is detected is made variable so that the heating device is rotated within a range of any angle reciprocatively.

In this configuration, the hair treatment promoting apparatus permits the hair of the subject to be partially heated and the heating device to be rotated reciprocatively within a desired angle. This satisfies the demand of the subject.

In accordance with the seventh aspect of this invention, there is provided a hair treatment promoting apparatus in which a reflecting plate is provided with a heater for radiating infrared rays is rotated by a motor so that the infrared rays are radiated to the top, back and both sides of a head of a subject, wherein at the time of start of rotation of the motor and actuation of the reversing of the rotating direction, driving torque of the motor is decreased so that the shock when the motor starts and stops can be reduced. In the hair treatment promoting apparatus, the torque of the motor is reduced by repeating at a desired number of times an operation of applying a partially cut AC voltage at every prescribed cycles of an AC voltage applied to the motor. In the hair treatment promoting apparatus, the torque of the motor is reduced by intermittently connecting or disconnecting a resistor connected in series to the motor.

In these configurations, the driving torque of the motor when the motor starts to rotate and reverses its rotating direction is decreased so that the shock at this time reduced. For this reason, the shock can be reduced even when the heating device is subjected to the reversing at desired periods. The operation for the hair based on the swing can be carried out in various manners. In addition, where the heating device is attached to the arm for suspending it from a ceiling, or to a stand equipped with casters, the heating device does not move owing to vibration, thereby making it possible to make appropriate hair treatment promotion.

The above and other objects and features of the invention will be more apparent from the following description taken in conjunction with the accompanying drawings.

DESCRIPTION OF THE PREFERRED EMBODIMENTS

Figure 1:
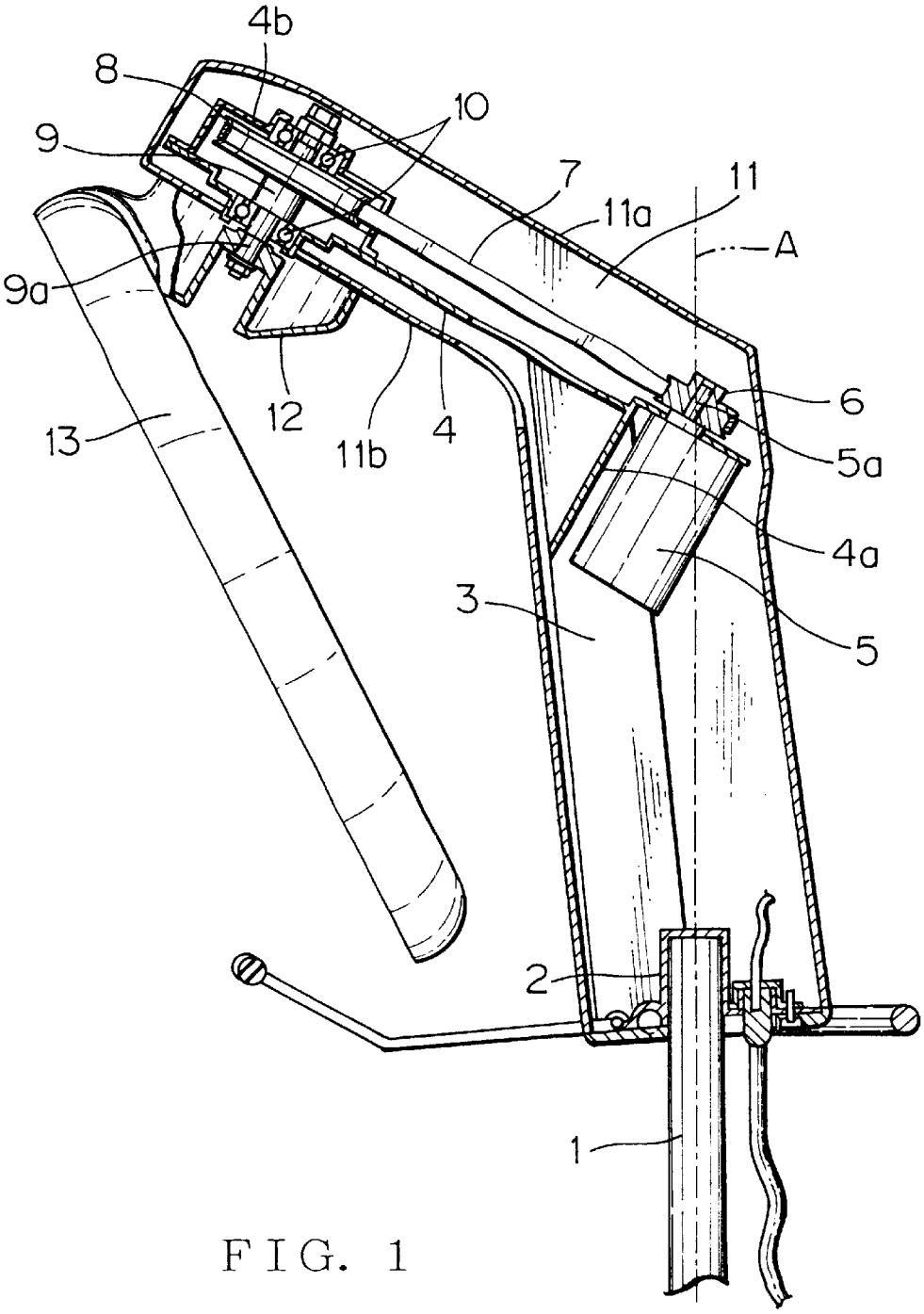
FIG. 1 is a sectional view of a hair treatment promoting apparatus according to an embodiment of this invention.

Now referring to the drawings, an explanation will be given of various embodiments of the hair treatment promoting device according to this invention.

FIG. 1 is a sectional view of an embodiment of the hair treatment promoting apparatus according to this invention. A reflector equipped with a heater for radiating infrared rays is structured so that a radiating unit for radiating infrared rays is rotated around the head along the top, rear and both sides of the head of a subject.

Reference numeral 1 denotes a rod which is movable vertically, attached to a moving stand. Numeral 2 denotes a stem of a hair treatment promoting apparatus body, which is removable from the rod 1. Numeral 3 is a base plate attached to the stem 2. Numeral 4 denotes a supporting plate attached to the base plate 3. A bracket 4*b* is attached to the one side of the supporting plate 4. A branching plate 4*a* is attached to the other end thereof remote from the one side and on a vertically extending line A of the rod 1. A motor 5 is attached to the branching plate 4*a*.

A rotary shaft 5*a* is attached to the motor 5. The rotary shaft 5*a* is provided with a pulley 6. A belt 7 is wound between the pulley 6 and another pulley 8.

A rotary shaft 9 is attached to the pulley 8. A rotary bracket 12 is attached to the tip 9*a* of the rotary shaft 9. A radiating unit 13, which includes a heater (not shown) which radiates infrared rays and a reflector (not shown), is attached to the rotary bracket 12. The rotary shaft 9 is pivotally supported on the supporting plate 4 and bracket 4*b* by bearings 10. Numerals 11*a* and 11*b* constitute a cover of the hair treatment promoting apparatus 11.

Figure 2:
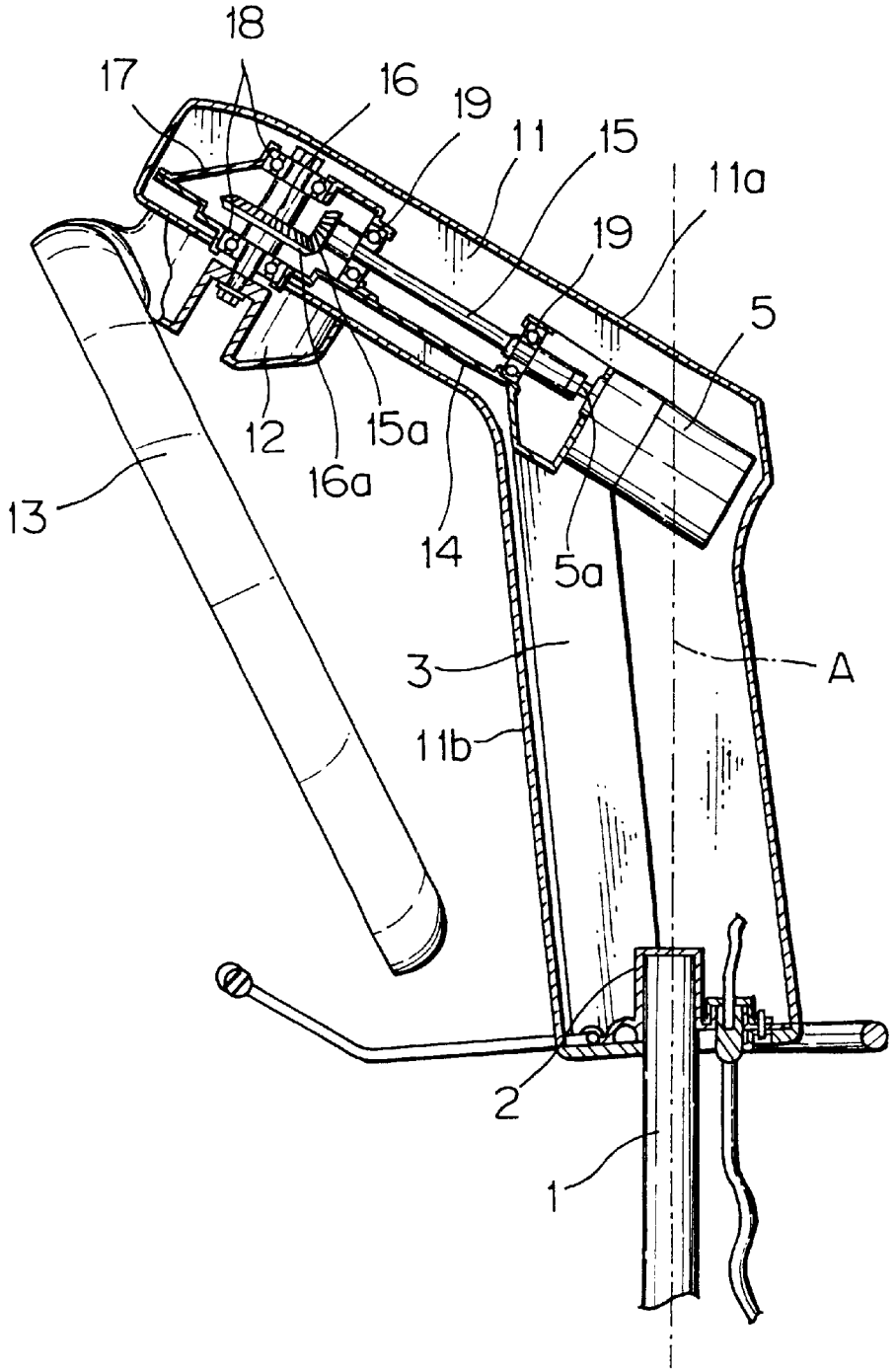
FIG. 2 is a sectional view of a hair treatment promoting apparatus according to another embodiment of this invention.

Referring to FIG. 2, an explanation will be given of another embodiment of the hair treatment promoting apparatus according to this invention. This embodiment is different from the embodiment shown in FIG. 1 in that the means for rotating the radiating unit 13 is modified. In FIG. 2, like reference numerals refer to like elements in FIG. 1.

A motor 5 is attached to a supporting plate 14 which is attached to the base plate 3. The motor 5 is located on an axial line A of the ascending/descending rod 1 attached to the moving stand.

A capping gear 15*a* having a lengthy output shaft 15 is attached to the tip of the rotary shaft 5*a* of the motor 5. The capping gear 15*a* is rotatably supported by a bearing 19 attached to the supporting plate 14.

Numeral 16 denotes a rotary shaft which is rotatably provided by bearings 18 which are engaged with the capping gear 15*a* and located between the supporting plate 15 and the brackets 17 attached thereto. A rotary bracket 12 is attached to the tip of the rotary shaft. Further, a radiating unit 13 which radiates infrared rays is attached to the rotary bracket 12.

In the hair treatment promoting apparatus according to this embodiment structured above, since the motor 5 which is relatively heavy is located on the axial line of the ascending/descending rod 1 attached to the main pole of the moving stand, the center of gravity of the entire body is located on the side of the moving stand, which contributes to the stability of the hair treatment promoting apparatus.

The angle of attaching the motor and the distance between the rotary shaft of the radiating unit and the motor can be changed as the occasion demands. Further, in this embodiment, as a transmitting means, the pulley-belt structure and the capping gear having a lengthy output shaft were used. Any transmitting means may be used as long as the motor is located on the axial line of the ascending/descending rod of the moving stand.

In this embodiment, since the motor 5 which is relatively heavy is located on the axial line of the ascending/descending rod 1 attached to the main pole of the moving stand, the hair treatment promoting apparatus is held in a stable state. Therefore, even if the apparatus is caught by any protrusion on the floor when the apparatus is moved for operation it does not easily fall down.

Figure 3:
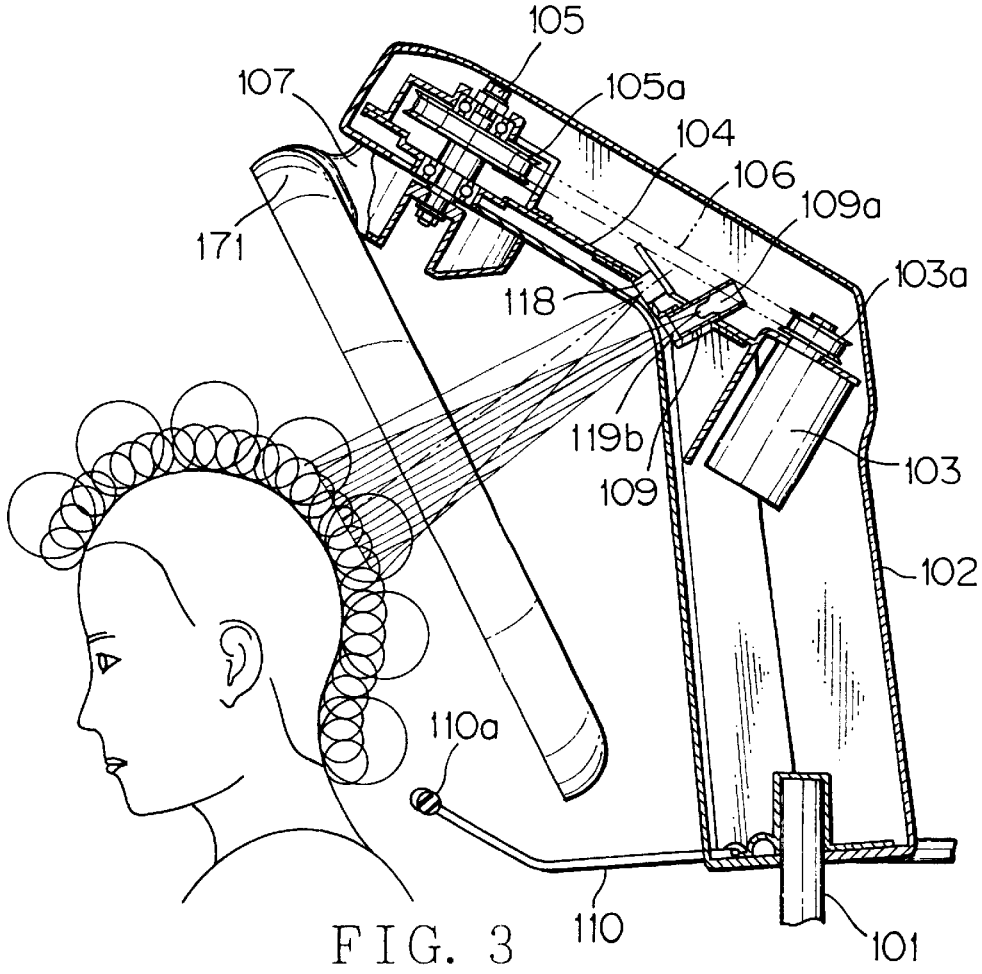
FIG. 3 is a sectional view of the hair treatment promoting apparatus having a head positioning device according to still another embodiment of this invention.

Now referring to FIG. 3, an explanation will be given of still another embodiment of the hair treatment promoting apparatus according to this invention, which is provided with a head positioning device. FIG. 3 is a sectional view of this embodiment. In FIG. 3, reference numeral 101 denotes an ascending/descending rod which can be moved vertically according to the height of a subject. A body case 102 is attached to the top of the rod. Numeral 103 denotes a motor fixed in a vertical portion of the body case 102. The motor 103 incorporates a decelerator (not shown).

Reference numeral 104 denotes a securing plate fixed in an inclining portion of the body case 102. The motor 103 and a rotary shaft 105 are pivotally supported to the one end and the other end of the securing plate 104. A pulley 105*a* is secured around the rotary shaft 105. A belt 106 is wound between the pulley 105*a* and another pulley 103*a* fixed around the output shaft of the motor 103.

Reference numeral 107 denotes a bracket (heating means) secured to a portion protruding from the body case 2. A cover 171 is formed integrally to the bracket 107. A ring-shaped reflector (not shown) is attached to the inside of the cover 171 and a heater for radiating infrared rays is attached to the inside of the reflector. The heater incorporates a heating wire such as a nichrome wire within a ring-shaped capillary made of quartz glass.

In this embodiment, the bracket 107 is rotated by transmitting the torque of the motor 103 through the belt 106. Otherwise, the bracket 107 may be rotated by transmitting the torque of the motor 103 via gear coupling between the motor 103 and the bracket 107.

The reflector and heater may not be ring-shaped, but may be arc-shaped or arm-shaped. The heater is energized through a rotary power feeder such as a slip-ring or brush (not shown) connected to a power supply line introduced in the body case 102.

Reference numeral 118 denotes a non-contact thermometer incorporated in a bended portion of the body case 102. The non-contact thermometer 118 serves to measure the temperature of the hair of the back part of the head of a subject who is sitting on a chair. Reference numeral 109 denotes a visible light emitting device for radiating visible light rays, which is arranged in proximity to the non-contact thermometer 118. The light emitting device 109 has an opening equipped with a light focusing means (e.g. lens, slit, pupil, etc. lens 109*a* in the embodiment) for focusing the visible light rays emitted from a light source 109*a* such as a lamp, LED, laser, etc. The light emitting device 109 is located to emit light toward the position where the temperature is measured by the non-contact thermometer 118.

Reference numeral 110 denotes a head position supporting bar with its one end secured to the lower part of the body case 102. The head position supporting bar 100 has a contact portion 110*a* of rubber at its tip. The contact portion is brought into contact with the neck of the subject who sits on a chair.

An explanation will be given of the operation of the hair treatment promoting apparatus according to this embodiment. First, in the state where the subject sits on the chair, the vertical position of the ascending/descending rod 101 is adjusted so that the center of the back of the subject's head is located at the center of the cover 171. In this adjustment, the contact portion 110*a* of the head position supporting bar 110 is set in the vicinity of the neck of the subject.

In this state, the light source 109*a* of the visible light emitting device 109 is turned on and the subject's head is tilted in front/rear and left/right directions so that the light focused by the lens 109*b* is located at the center of the back of the subject's head, i.e. position where the hair's temperature is measured by the non-contact thermometer 118. When the focused light does not coincide with the above position, the ascending/descending rod 1 is finely adjusted.

After the focused light has coincided with the position where the temperature of the back of the subject's head is measured by the thermometer 118, the heater is energized and the motor 103 is also energized. Then, the heater heats the entire head of the subject at a prescribed temperature while it is rotated. This promotes the hair treatment, e.g. drying of the washed hair, promotion of hair dyeing and permanent waving of the hair.

If the subject moves his head while the hair treatment promotion is executed, the temperature of the hair suddenly rises or falls. In this case, the temperature of the heater is controlled on the basis of the temperature measured by the non-contact thermometer. Therefore, when the head leaves the heater, the temperature rises, and when the head approaches the heater, the temperature falls. Thus, even when the subject moves the head, the temperature of the hair is kept constant. When the subject moves his head too far or close to permit temperature adjustment by heater control, a warning is issued on the basis of the output from the non-contact thermometer.

In accordance with this embodiment, since the visible light emitting device can be set at an optimum position relative to the position of the subject's head, and is positioned at the position where the hair's temperature of the subject's head can be measured by the non-contact thermometer, the light emitting device is initially set at an optimum state to make temperature control, thereby promoting the hair treatment at the temperature suited to the subject's hair.

Further, since the light from the visible light emitting device is focused by a lens, the position of the emitted light can be easily recognized. This facilitates positioning of the light emitting device. Further, since the subject's head has been set using the head position supporting bar, the visible light emitting deice is positioned. Thus, the hair treatment promoting apparatus can be set accurately with improved operability.

Figure 4:
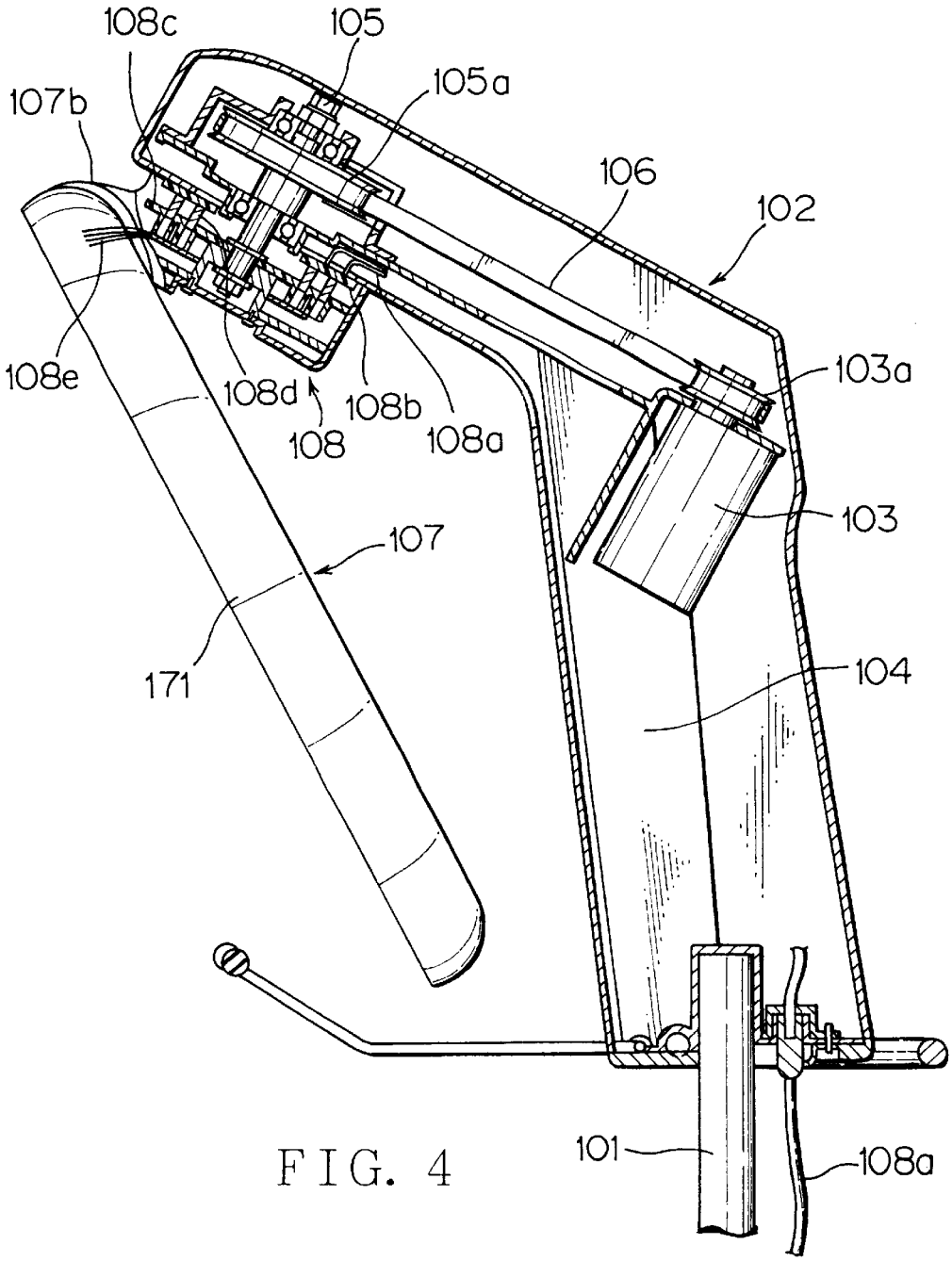
FIG. 4 is a sectional view of a hair treatment promoting apparatus having a heater attaching structure and a reflecting structure according to yet another embodiment of this invention.
Figure 5:
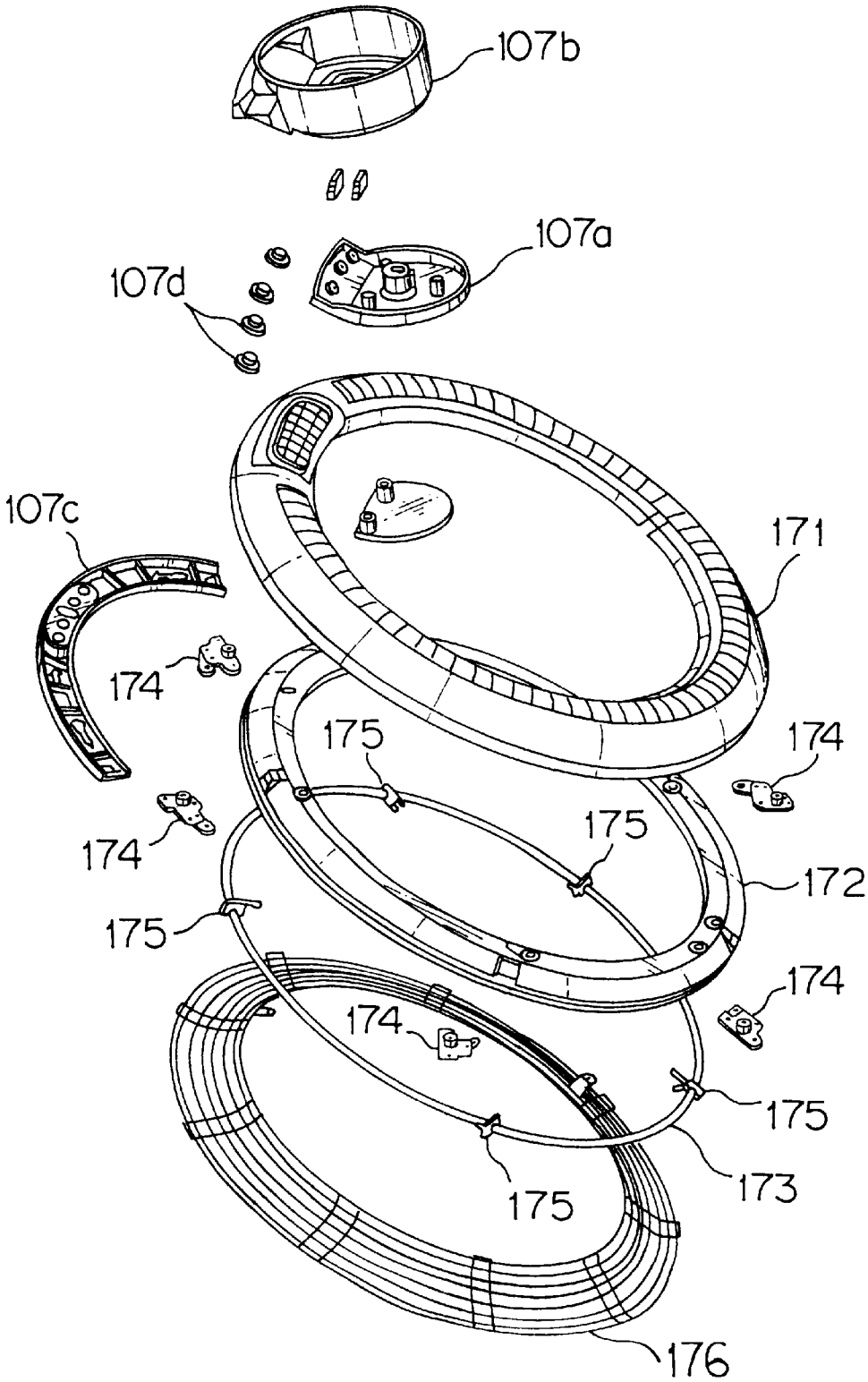
FIG. 5 is an exploded perspective view of a heating device shown in FIG. 4.
Figure 6:
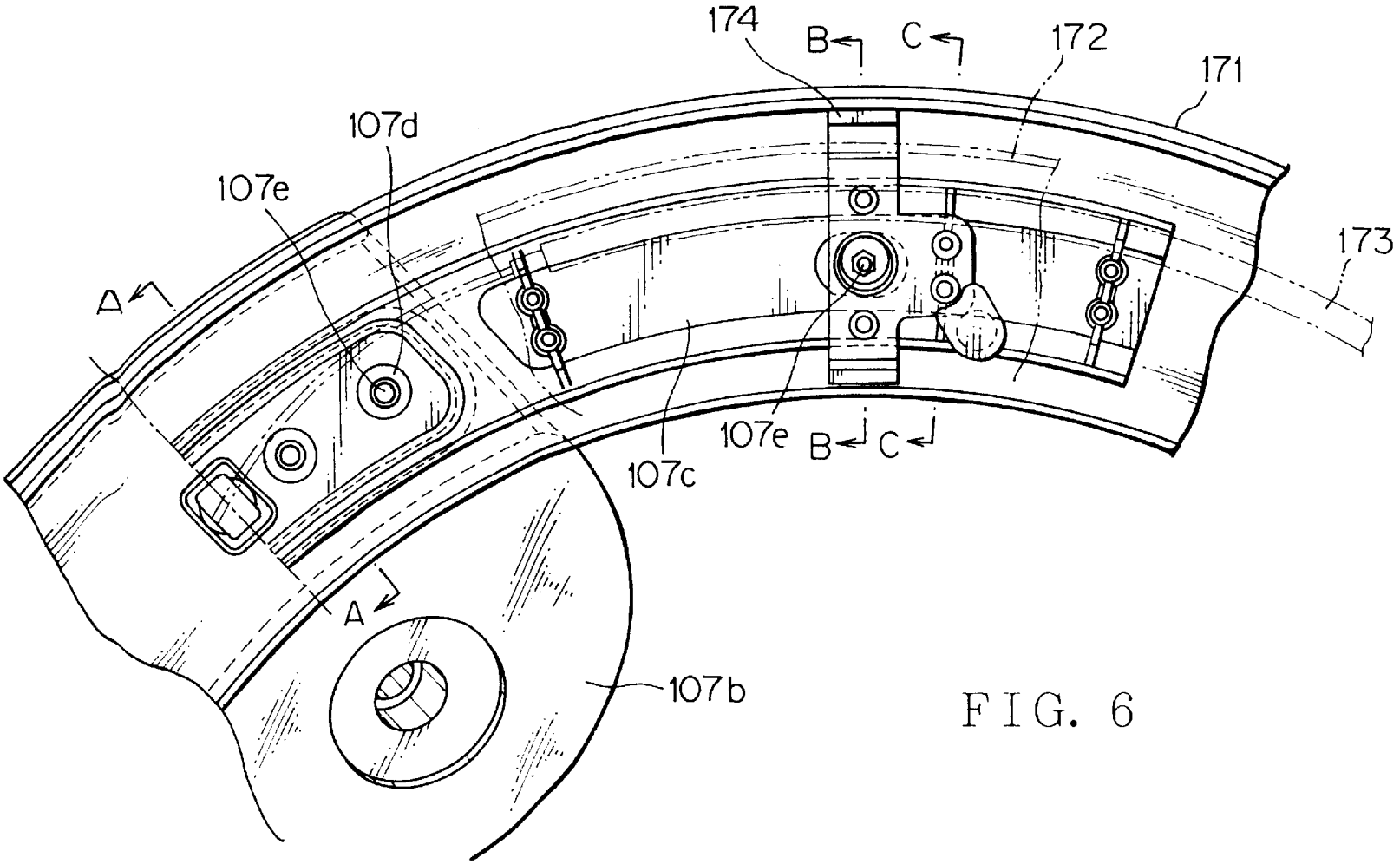
FIG. 6 is a rear side view of the ring frame shown in FIG. 5.

Referring to FIGS. 4 to 14, an explanation will be given of a hair treatment promoting apparatus according to still another embodiment of this invention. The feature of this embodiment resides in a heater attaching structure and a reflecting plate structure. FIG. 4 is a sectional view of the entire structure of this embodiment. In FIG. 4, like reference numerals refer to like elements or parts in FIG. 3. In FIG. 4, reference numeral 101 denotes an ascending/descending rod which can be moved vertically according to the height of a subject. A body case 102 is attached to the top of the rod. Numeral 103 denotes a motor fixed in a vertical portion of the body case 102. The motor 103 incorporates a decelerator (not shown).

Reference numeral 104 denotes a securing plate fixed in an inclining portion of the body case 102. The motor 103 and a rotary shaft 105 are pivotally supported to the one end and the other end of the securing plate 104. A pulley 105*a* is secured around the rotary shaft 105. A belt 106 is wound between the pulley 105*a* and another pulley 103*a* fixed around the output shaft of the motor 103.

Reference numeral 107 denotes a bracket incorporating a heating means secured to a portion protruding from the body case 2. A cover 171 is formed integrally to the heating means 107. A ring-shaped reflector 172 described later is attached to the inside of the cover 171 and a heater 173 for radiating infrared rays is attached to the inside of the reflector. The heater incorporates a heating wire such as a nichrome wire within a ring-shaped capillary made of ceramic, quartz glass, etc.

In this embodiment, the heating means 107 is rotated by transmitting the torque of the motor 103 through the belt 106. Otherwise, the bracket 107 may be rotated by transmitting the torque of the motor 103 via gear coupling between the motor 103 and the bracket 107.

Reference numeral 108 denotes a rotary power-feeding device for feeding power from a power source code 108*a* introduced in the body case 102 to the above heater. The rotary power-feeding device has a fixed electrode 108*b* and a rotary electrode 108*c*. A rod-like brush 108*d* of the rotary electrode 108*c* is brought into elastic contact with the fixed electrode 108*b* so that the heater 173 is energized through a lead wire 1083.

Referring to FIGS. 5 to 12, an explanation will be given of the details of the heating device 107. The heating device 107 includes a spinner frame 107*a* secured to the rotary shaft 105 by a nut, a spinner cover 107*b* covering the outer periphery of the spinner frame 7*a*, a semi-circular metallic ring frame 107*c* screwed to the spinner frame 107*a* together with the cover 171, a circular reflecting plate 172 secured to the ring frame 107*a*, fixed metal fittings 174 of a heat insulating material for attaching the reflecting plate 172 to the ring frame 107*a*, heater attaching pieces for securing the circular heater 173 to the reflecting plate 172, and a protecting net 176 which covers the opening face of the cover 171.

As described above, the semi-circular metallic ring frame 107*c* as well as the cover 171 is screwed to the spinner frame 107*a*. In this screwing, they are screwed to the spinner frame using screws 107*e* (FIG. 6) through insulating caps 107*d*. Therefore, the ring frame 107*c* is electrically insulated from the rotary power-feeding device 108. Accordingly, even if a person touches the reflecting plate 172, he does not get electric shock.

Figure 8:
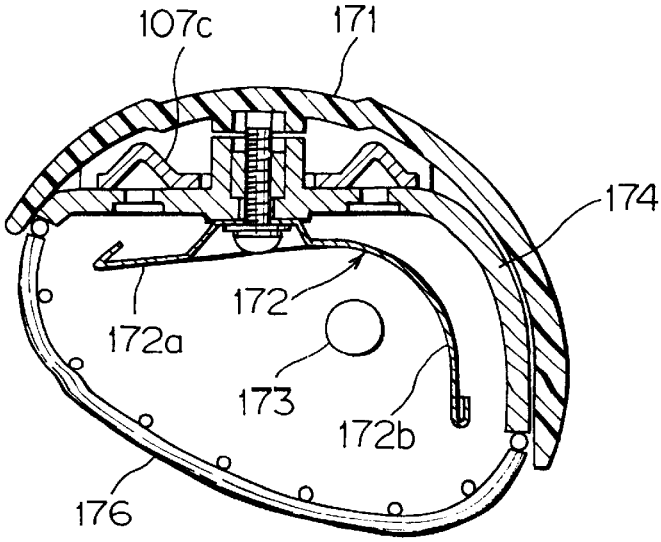
FIG. 8 is a sectional view taken in line B—B in FIG. 6.

The reflecting plate 172 is located on the rear side of the cover 171. The reflecting plate 172 is screwed to the ring frame 107*c* by two metal fittings 174 (FIGS. 6 and 7) and is also screwed to the cover 173 by three metal fittings 174 (FIG. 8). The cover 171 and the reflecting plate 172 are spaced by a prescribed distance so that even when the reflecting plate is heated by the heater 173, the generated heat is not directly conducted to the cover 171.

Figure 7:
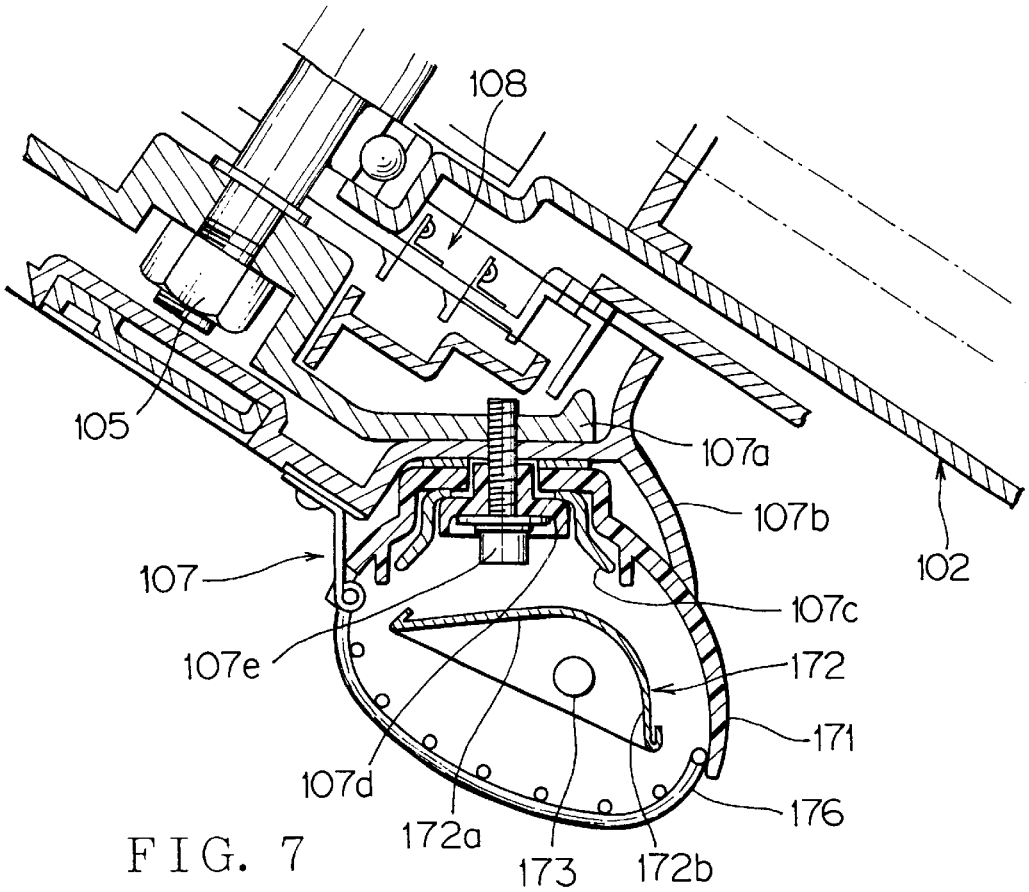
FIG. 7 is a sectional vies taken in line A—A in FIG. 6.
Figure 9:
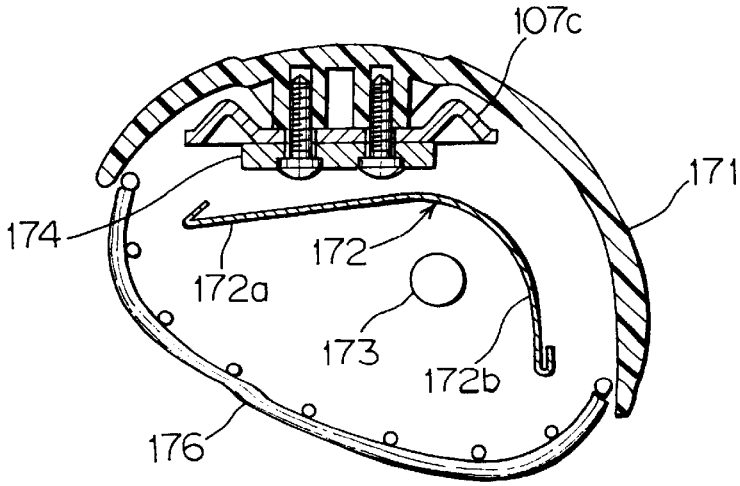
FIG. 9 is a sectional view taken in line C—C in FIG. 6.
Figure 14:
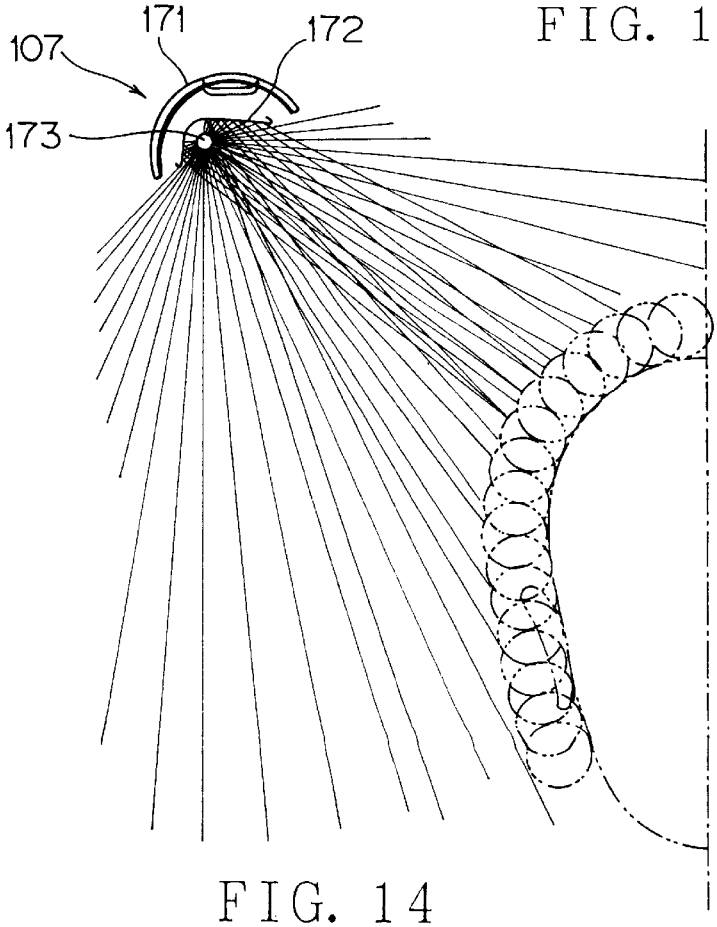
FIG. 14 is a front view of a half-sectional front view.
Figure 13:
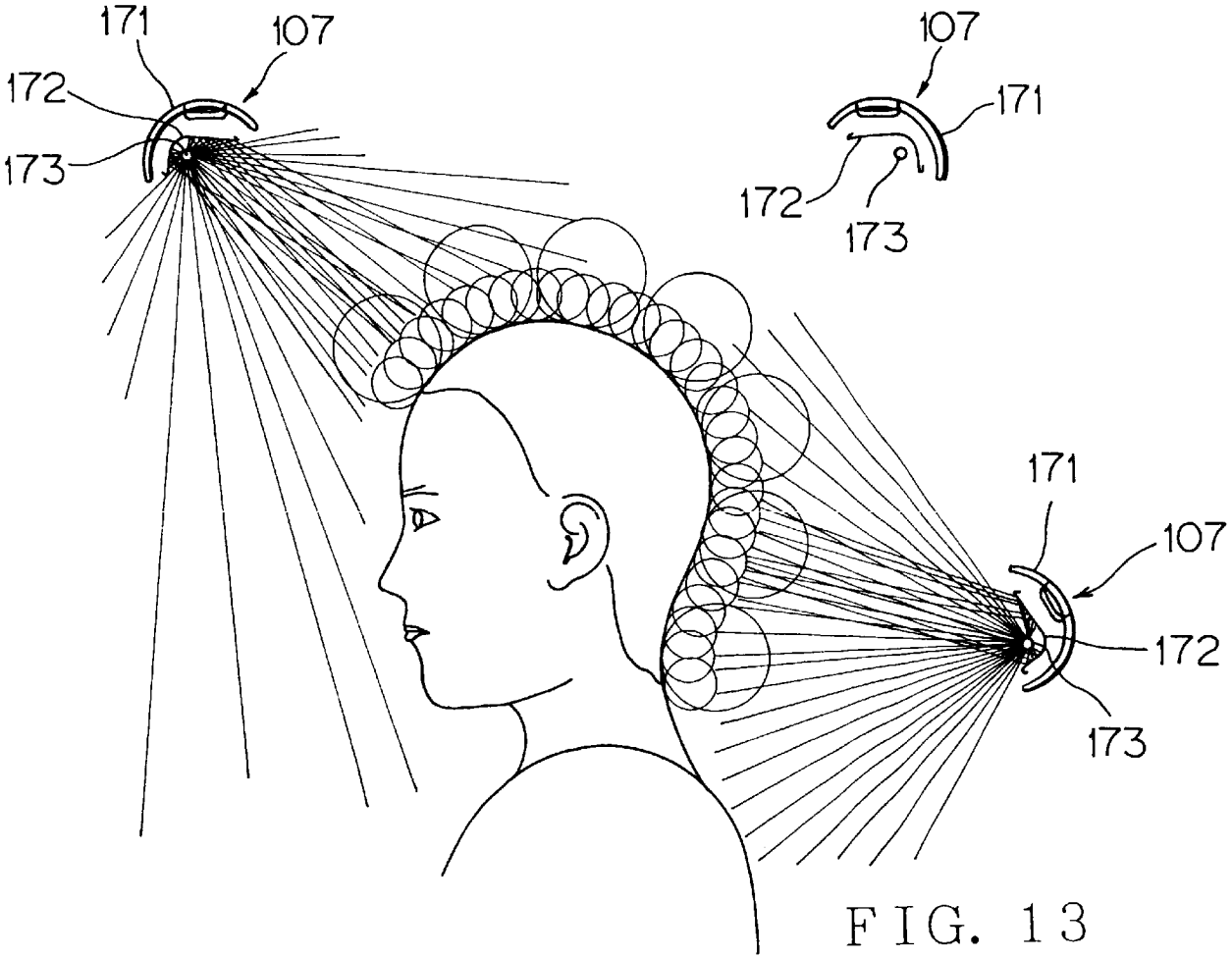
FIG. 13 is a side view of an radiated state of infrared rays.

The reflecting plate 172, as seen from FIGS. 7 to 9, is composed of a linear segment 172*a* and bending segment 172*b*, which is different from the conventional bowl-shaped reflecting plate. Because of such a shape, as shown in FIGS. 13 and 14, when the heating device 107 is rotated along the top, back and both sides of the subject's head, the heat reflected by the reflecting plate 172 is not concentrated to a point, unlike the conventional reflecting plate, and distributed uniformly. This greatly enhances the efficiency of light radiation.

Figure 10A:
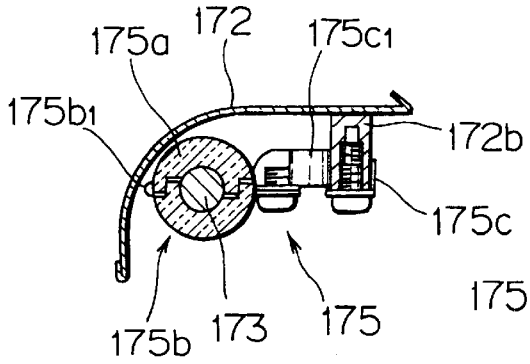
FIGS. 10A and 10B are a sectional view of an structure of the heater attaching tool shown in FIG. 4 and a bottom view of thereof, respectively.
Figure 10B:
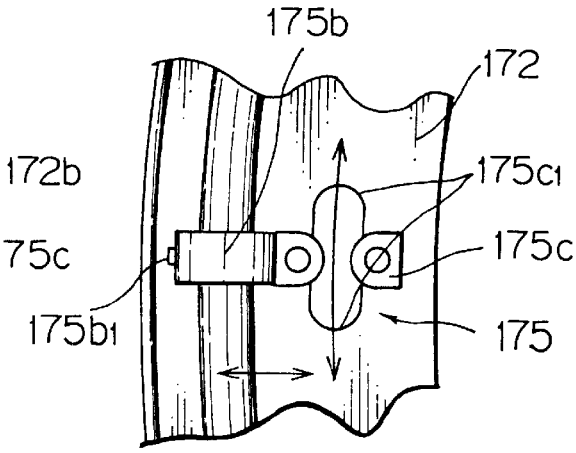
Figure 11A:
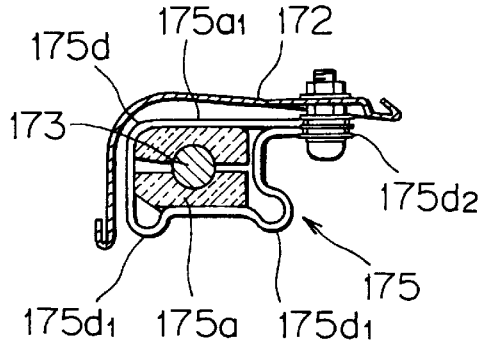
FIGS. 11A and 11B are a sectional view of another structure of the heater attaching tool shown in FIG. 4 and a bottom view of thereof, respectively.
Figure 11B:
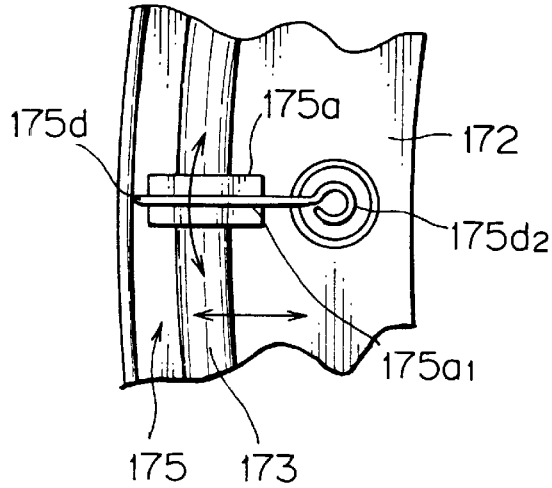
Figure 12A:
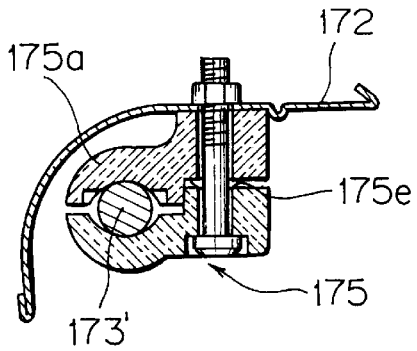
FIGS. 12A, 12B and 12C are a sectional view of a sliding portion of still another structure of the heater attaching tool shown in FIG. 4, a sectional view of a fixed portion thereof, and an explanation view of the state where it is attached, respectively.
Figure 12B:
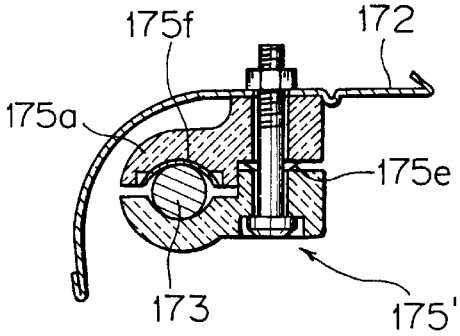
Figure 12C:
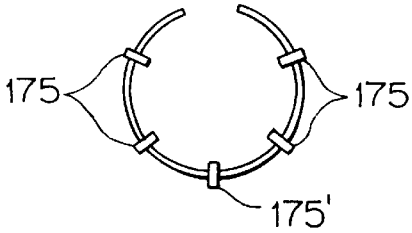

Referring to FIGS. 10 to 12, an explanation will be given of heater attaching pieces 175 for attaching the heater 173 to the reflecting plate 172. As seen from FIG. 10, the heater attaching piece 175 includes an insulator 175*a* which is separated into two segments 175*a*1 along the longitudinal direction of the heater 173, a first flat spring 175*b* which is provided with a swelling portion 175*b*1 and elastically sandwiches the outer periphery of the insulator 175*a*, and a second flat spring 175*c* which has a swelling segment 175*c*1 orthogonal to the first flat spring 175*b* and is secured to the first flat spring 175*b* at its one end and screwed to a pin 172*b* vertically extending from the reflecting plate 172.

In the heater attaching pieces 175 structured as described above, the swelling portion 175*b*1 of the first flat spring 175*b* absorbs the force enlarging the intervals between the insulator segments 175*a*1 when the heater 173 expands in a radial direction whereas the swelling portion 175*c*1 of the second flat spring 175*c* absorbs the force when the heater 173 expands in a longitudinal direction. Therefore, when the heater 173 is expanded in either radial direction or longitudinal direction, the heater 173 does not apply undue force to the reflecting plate 172.

Now referring to FIG. 11, an explanation will be given of another structure of a heater attaching piece 175. In FIG. 11, like reference numerals refer to like elements in FIG. 10. In this example, a spring wire 175*d* is employed in place of the flat spring 175.

The spring wire 175*d* is fit in a groove 175*a*1 formed on the entire periphery of the insulator 175*a* and has swelling portions 175*b*1 at two positions. The spring wire 175*d* has ring-shaped portions d2 at both ends. These ring-shaped portions 175*d*2 are screwed to the reflecting plate 172.

In the heater attaching pieces 175 structured as described above, the swelling portions 175*d*1 of the spring wire 175*d* absorb the force enlarging the intervals between the insulator segments 175*a*1 when the heater 173 expands in a radial direction whereas the swelling portion 175*d*2 of the spring wire 175*d* absorb, by its rotation for the screw, the expansion of the heater 173 in a longitudinal direction. Therefore, when the heater 173 is expanded in either radial direction or longitudinal direction, the heater 173 does not apply undue force to the reflecting plate 172.

Referring to FIG. 12, an explanation will be given given of another structure of a heater attaching piece 175. In FIG. 12, like reference numerals refer to like elements in FIG. 10. In this example, the heater 173 is attached to the reflecting plate 172 using heater attaching pieces 175 at five positions. The central heater attaching piece 175 is different from the remaining four heater attaching pieces 175' in their structures.

The heater attaching pieces 175 and 175' are similar to each other in that the insulators 175*a* are directly screwed to the reflecting plate 172 and an elastic member 175*e* such as an oval counter-sunk screw is sandwiched between the insulators. However, the heater attaching pieces 175' is different from the heater attaching piece 175 in that a metallic fixing bar 175*f* is sandwiched between the insulator 175*a* and the heater 173.

In the heater attaching pieces 175 and 175' structured as described above, the elastic force of the elastic member 175*e* absorb the increase of the intervals between the insulator segments 175*a*1 when the heater 173 expands in a radial direction. On the other hand, with respect to the expansion of the heater 173 in the longitudinal direction, the heater attaching pieces 175', which support the central portion of the heater 173, secure the heater 173 by the insulator 175*a* with the aid of the fixed bar 175*f* whereas the heater attaching piece 175 permits the heater 173 to be expanded with the aid of the gap between the insulator 175*a* and the heater 173. Therefore, when the heater 173 is expanded in either radial direction or longitudinal direction, the heater 173 does not apply undue force to the reflecting plate 172.

As described above, the heater attaching structure is provided in which the heater is elastically sandwiched by the segments of the insulator which is attached so as to be displaceable for the reflecting plate in the longitudinal direction. Because of such a configuration, even when the heater is increased in width and length owing to thermal expansion, the increase can be absorbed. Therefore, the thermal expansion of the heater does not give deformation to the reflector, and metallic friction sound is not also generated.

When the heater is not energized, since there is no gap between the heater and insulator, alien sound, which may be generated due to hand touching and thermal expansion of the heater, is prevented and the necessary insulating distance between the reflecting plate and the heat is kept.

Since the reflecting plate composed of a linear segment and a bending segment is attached to the cover so that the bending segment is located outside, the heat radiation form the heater is improved.

As described above, the ring-frame is secured to the rotary power feeding device through the insulating cap and the reflecting plate is attached to the ring frame. In this way, the reflecting plate is electrically insulated from the rotary power feeding device so that the operator does not get electric shock when he touches the reflecting plate.

The reflecting plate is attached to the cover through the heat-resistant resin so that a suitable distance is held between the reflecting plate and the cover, thereby preventing the cover from being heated. For this reason, even when the operator and subject touch the cover, they do not burn their hand.

Figure 15:
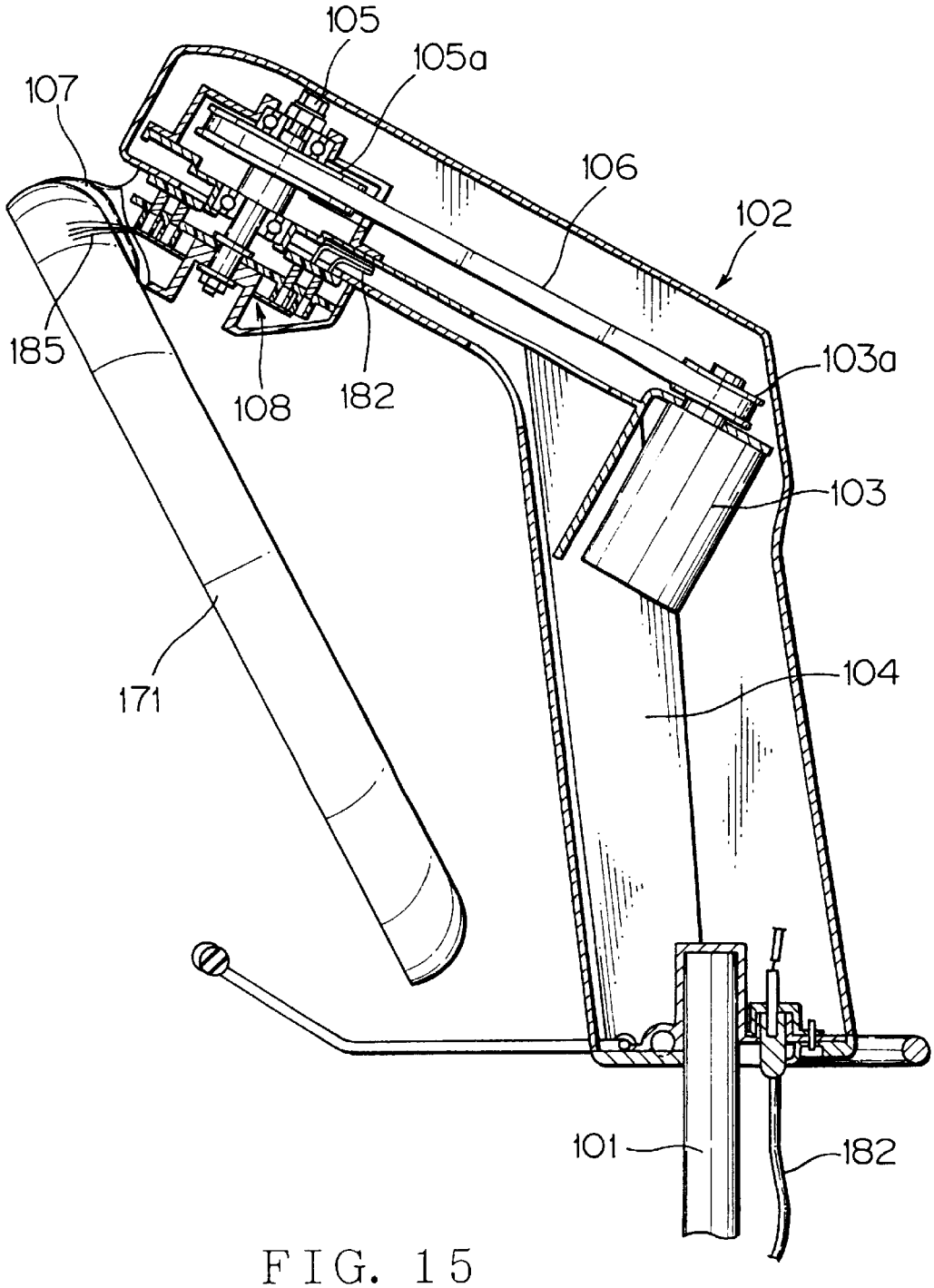
FIG. 15 is a sectional view of a hair treatment promoting apparatus having a rotary power-feeding device according to a further embodiment of this invention.

Referring to FIGS. 15 to 19, an explanation will be given of a hair treatment promoting apparatus according to a further embodiment of this invention. The feature of this embodiment resides in a rotary power feeding device. FIG. 15 is a sectional view of the entire structure of this embodiment. In FIG. 15, like reference numerals refer to like elements or parts in FIG. 4. In FIG. 15, reference numeral 101 denotes an ascending/descending rod which can be moved vertically according to the height of a subject. A body case 102 is attached to the top of the rod. Numeral 103 denotes a motor fixed in a vertical portion of the body case 102. The motor 103 incorporates a decelerator (not shown).

Reference numeral 104 denotes a securing plate fixed in an inclining portion of the body case 102. The motor 103 and a rotary shaft 105 are pivotally supported to the one end and the other end of the securing plate 104. A pulley 105*a* is secured around the rotary shaft 105. A belt 106 is wound between the pulley 105*a* and another pulley 103*a* fixed around the output shaft of the motor 103.

Reference numeral 107 denotes a bracket incorporating a bracket (heating means) secured to a portion protruding from the body case 2. A cover 171 is formed integrally to the heating means 107. A ring-shaped reflector (not shown) is attached to the inside of the cover 171 and a heater (not shown) for radiating infrared rays is attached to the inside of the reflector. The heater incorporates a heating wire such as a nichrome wire within a ring-shaped capillary made of ceramic, quartz glass, etc.

In this embodiment, the heating means 107 is rotated by transmitting the torque of the motor 103 through the belt 106. Otherwise, the bracket 107 may be rotated by transmitting the torque of the motor 103 via gear coupling between the motor 103 and the bracket 107. The reflector and heater may not be ring-shaped, but may be arc-shaped or arm-shaped.

Figure 16:
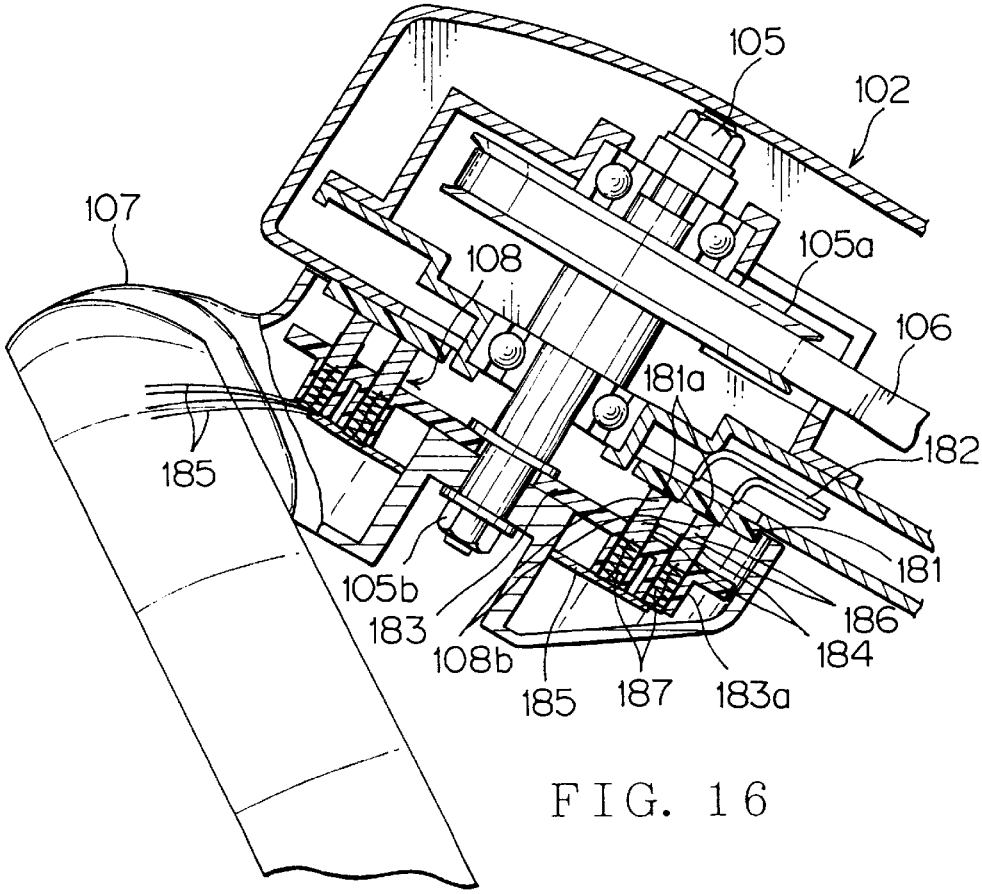
FIG. 16 is a partially sectional view of a rotary power feeding device incorporated in the apparatus shown in FIG. 15.

Reference numeral 108 denotes a rotary power-feeding device for feeding power introduced in the body case 102 to the above heater. FIG. 16 shows the details of the power-feeding device. In FIG. 16, reference numeral 181 denotes a base plate secured within the body case 102. On the rear surface, a ring-shaped fixed electrode 181*a* composed of two concentric-circular strips is formed. Each of the fixed electrodes 181*a* is connected to lead wires 182 from the power source introduced in the body case.

Reference numeral 183 denotes a brush supporting plate which is secured simultaneously when the bracket 107 is secured to the rotary shaft 105 by a nut 105*b*. Cylindrical portions 183*a* in which metallic brush holders 184 are to be fit are made at four points on the brush supporting plate 183. The brush holder 184 is connected to a lead wire 185 for energizing the heater.

Figure 18:
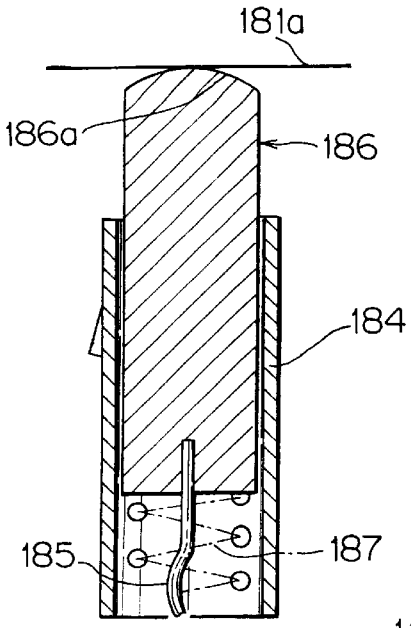
FIG. 18 is a sectional view of the brush when it is manufactured.
Figure 19:
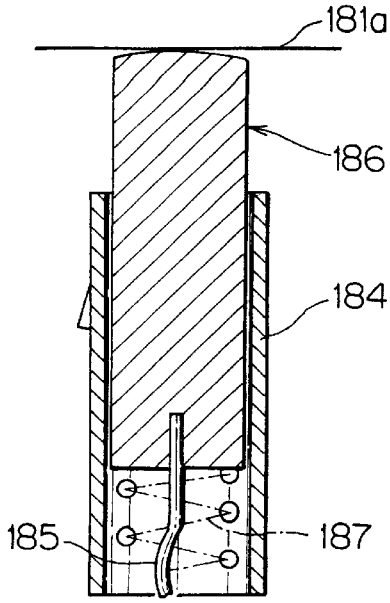
FIG. 19 is a sectional view of the brush in its used state.

Reference numeral 186 denotes a cylindrical or prism-like brush which has a size enough to move in the brush holder 184. A tip 186*a* of the brush 186 which is contact with the fixed electrode 181*a* is formed in an arc-shape as shown in FIG. 18.

Incidentally, two or more brushes 186 may be arranged oppositely to the single fixed electrode 181*a* so that the one is connected to ground and the other is used for a sub-heater (not shown).

A tip of the lead wire 185 is integrated with the brush 186 during its sintering. The brush holder 184 incorporates a spring 187 for urging the tip of the brush 186 toward the fixed electrode 181*a*.

An explanation will be given of the operation of the power feeding device. When the motor 103 rotates to rotate the rotary shaft 105, the brush supporting plate 183 is rotated together with the bracket 107 to which the heater is attached. Thus, since the brush supporting plate 183 is rotated with the tip of the brush 186 in slidable contact with the fixed electrode 181*a*, the current from the lead wire 182 flows through the brush 186 to the lead wire 185 so that the heater is energized.

Figure 17A:
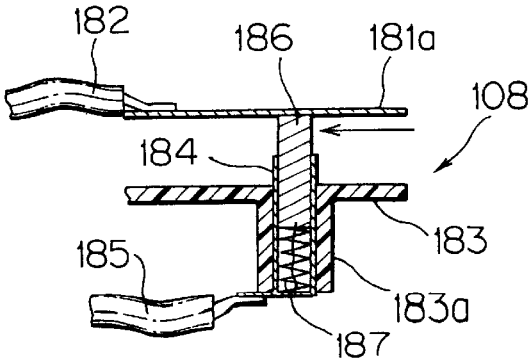
FIGS. 17A and 17B are a sectional view of the state while a brush rotates in a right direction in the contact state between a ring-shaped electrode and the brush in the rotary power-feeding device and a section of the state while the brush rotates in a left direction therein, respectively.
Figure 17B:
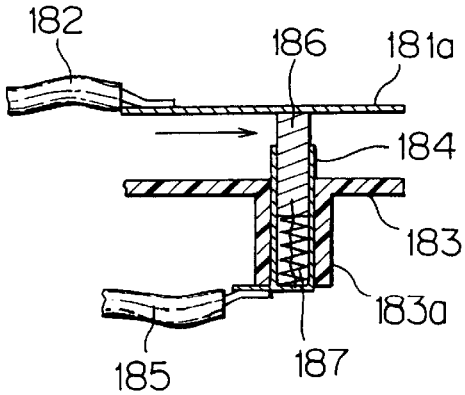

When the brush 186 rotates in a direction of arrow in FIG. 17A, it leans leftward. If this rotation continues, the tip 186*a* of the brush 186 suffers from unsymmetrical wear. When the brush 186 rotates in an opposite direction as shown in FIG. 17B, it leans rightward. In this case also, the tip 186*a* suffers from the unsymmetrical wear in the opposite direction.

In order to obviate such an inconvenience, in this embodiment, the tip 186*a* is formed in an arc-shape when the brush 186 is manufactured, and the motor 103 is rotated in a reversed direction for each desired time (half of the entire time for hair treatment promotion). Because of this, the tip 186*a* does not suffer from the asymmetrical wear. Specifically, as seen from FIG. 19, the tip 186*a* of the brush 186 is kept in the arc-shape so that poor contact does not occur owing to the asymmetrical wear does not occur.

In the embodiment, the brush 186 is rotated, the base plate 181 while the fixed electrode 181*a* is stationary. However, with the brush 186 being stationary, the base plate 181 may be rotated.

As described above, in this embodiment, the power feeding device, in which the heater is energized from the power source at the fixed electrode, includes a plurality of brushes urged by springs and the ring-shaped electrode in contact with each of the brushes. Because of such a configuration, unlike the conventional power feeding device using a flat spring, the power feeding device according to this embodiment is not subjected to a change in the spring constant, displacement of the brush from the ring-shaped electrode and poor contact due to the damage of the flat spring.

Where two or more rod-like brushes are arranged oppositely to the single ring-shaped electrode, even when the one brush leaves from the ring-shaped electrode, sure contact therebetween can be made, thereby realizing power feeding. The other brush can be used for the power source for the other purpose. Further, since the rotating direction of the motor is reversed at prescribed timings, the rod-like brush does not suffer from asymmetrical wear. Therefore, on the basis of the stable contact between the fixed electrode and the brush, power can be fed for the use for a long time.

Figure 20:
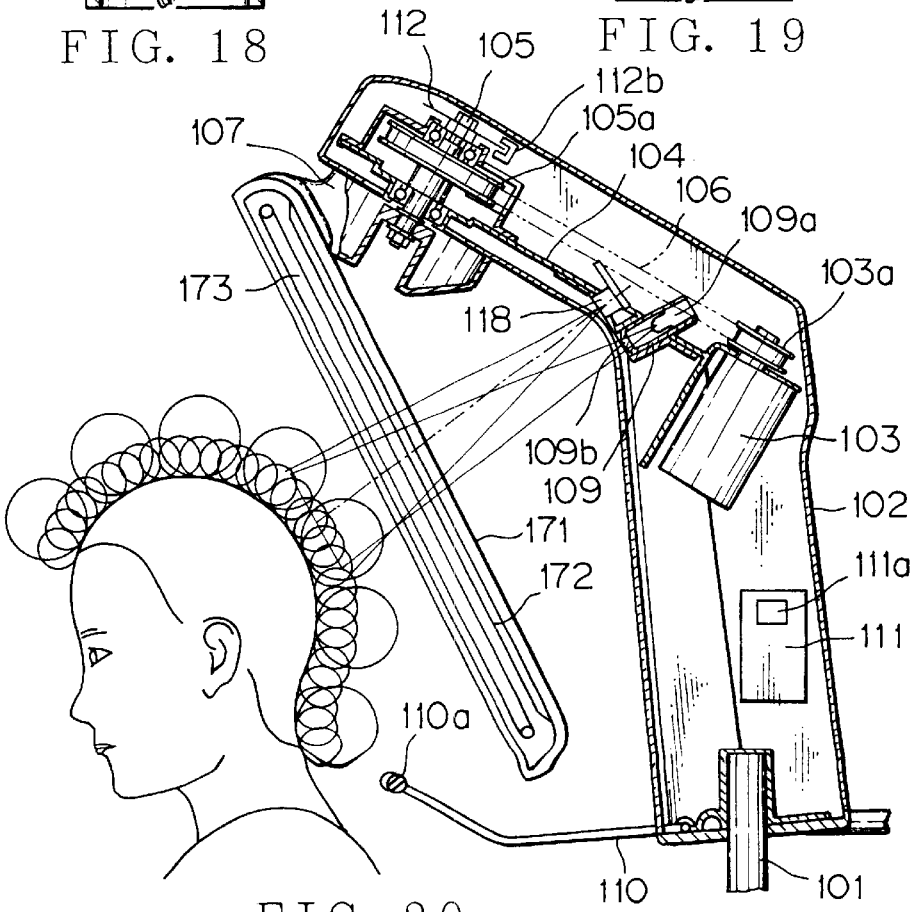
FIG. 20 is a sectional view of a hair treatment promoting apparatus including a rotation control device for a heating device and shock reducing device for reducing shock when a motor is started.

Referring to FIGS. 20–24, an explanation will be given of a hair treatment promoting apparatus according to a still further embodiment of this invention. The feature of this embodiment resides in a rotation control device for a heating device and a shock reducing device in motor starting. FIG. 20 is a sectional view of the entire structure of this embodiment. In FIG. 20, like reference numerals refer to like elements or parts in FIG. 15. In FIG. 20, reference numeral 101 denotes an ascending/descending rod which can be moved vertically according to the height of a subject. A body case 102 is attached to the top of the rod. Numeral 103 denotes a motor fixed in a vertical portion of the body case 102. The motor 103 incorporates a decelerator (not shown).

Reference numeral 104 denotes a securing plate fixed in an inclining portion of the body case 102. The motor 103 and a rotary shaft 105 are pivotally supported to the one end and the other end of the securing plate 104. A pulley 105*a* is secured around the rotary shaft 105. A belt 106 is wound between the pulley 105*a* and another pulley 103*a* fixed around the output shaft of the motor 103.

Reference numeral 107 denotes a bracket incorporating a bracket (heating means) secured to a portion protruding from the body case 2. A cover 171 which is made of a right material of synthetic resin is formed integrally to the heating means 107. A ring-shaped reflector 172 is attached to the inside of the cover 171 and a heater 173 for radiating infrared rays is attached to the inside of the reflector. The heater incorporates a heating wire such as a nichrome wire within a ring-shaped capillary made of ceramic, quartz glass, etc.

In this embodiment, the heating means 107 is rotated by transmitting the torque of the motor 103 through the belt 106. Otherwise, the bracket 107 may be rotated by transmitting the torque of the motor 103 via gear coupling between the motor 103 and the bracket 107.

The reflector and heater may not be ring-shaped, but may be arc-shaped or arm-shaped. The heater is energized through a rotary power feeder such as a slip-ring or brush (not shown) connected to a power supply line introduced in the body case 102.

Reference numeral 118 denotes a non-contact thermometer incorporated in a bended portion of the body case 102. The non-contact thermometer 118 serves to measure the temperature of the hair of the back part of the heat of a subject who is sitting on a chair. Reference numeral 109 denotes a visible light emitting device for radiating visible light rays, which is arranged in proximity to the non-contact thermometer 118. The light emitting device 109 has an opening equipped with a light focusing means (e.g. lens, slit, pupil, etc. lens 109*a* in the embodiment) for focusing the visible light rays emitted from a light source 109*a* such as a lamp, LED, laser, etc. The light emitting device 109 is located to emit light toward the position where the temperature is measured by the non-contact thermometer 118.

Reference numeral 110 denotes a head position supporting bar with its one end secured to the lower part of the body case 102. The head position supporting bar 110 has a contact portion 110*a* of rubber at its tip. The contact portion is brought into contact with the neck of the subject who sits on a chair.

Figure 21:
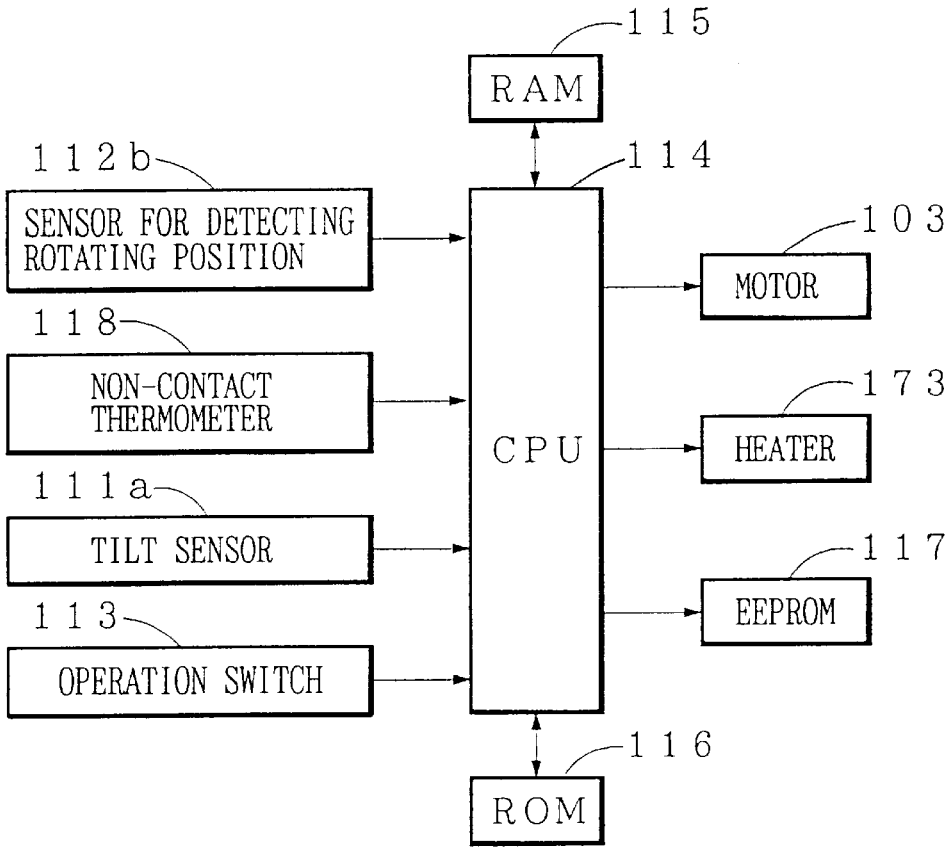
FIG. 21 is a block diagram of a control circuit built in the apparatus shown in FIG. 20.

Reference numeral 111 denotes a control plate incorporating a control circuit having a configuration as shown in FIG. 21. The control plate 111 is provided with a tilt sensor 111*a* which produces a signal for interrupting energization of the heater 173 when the body case 103 tilts by a prescribed angle, e.g. 15° in any direction from its upright state.

Figure 24:
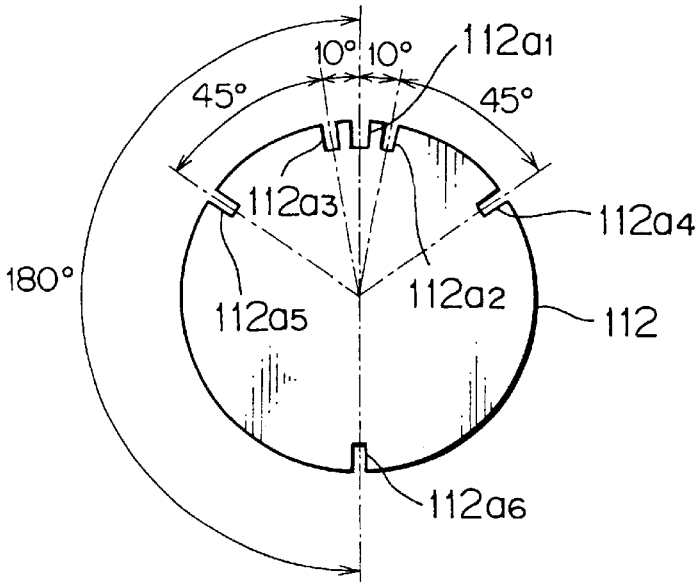
FIG. 24 is a front view of the disk with slits formed for stopping a heating device.
Figure 25:
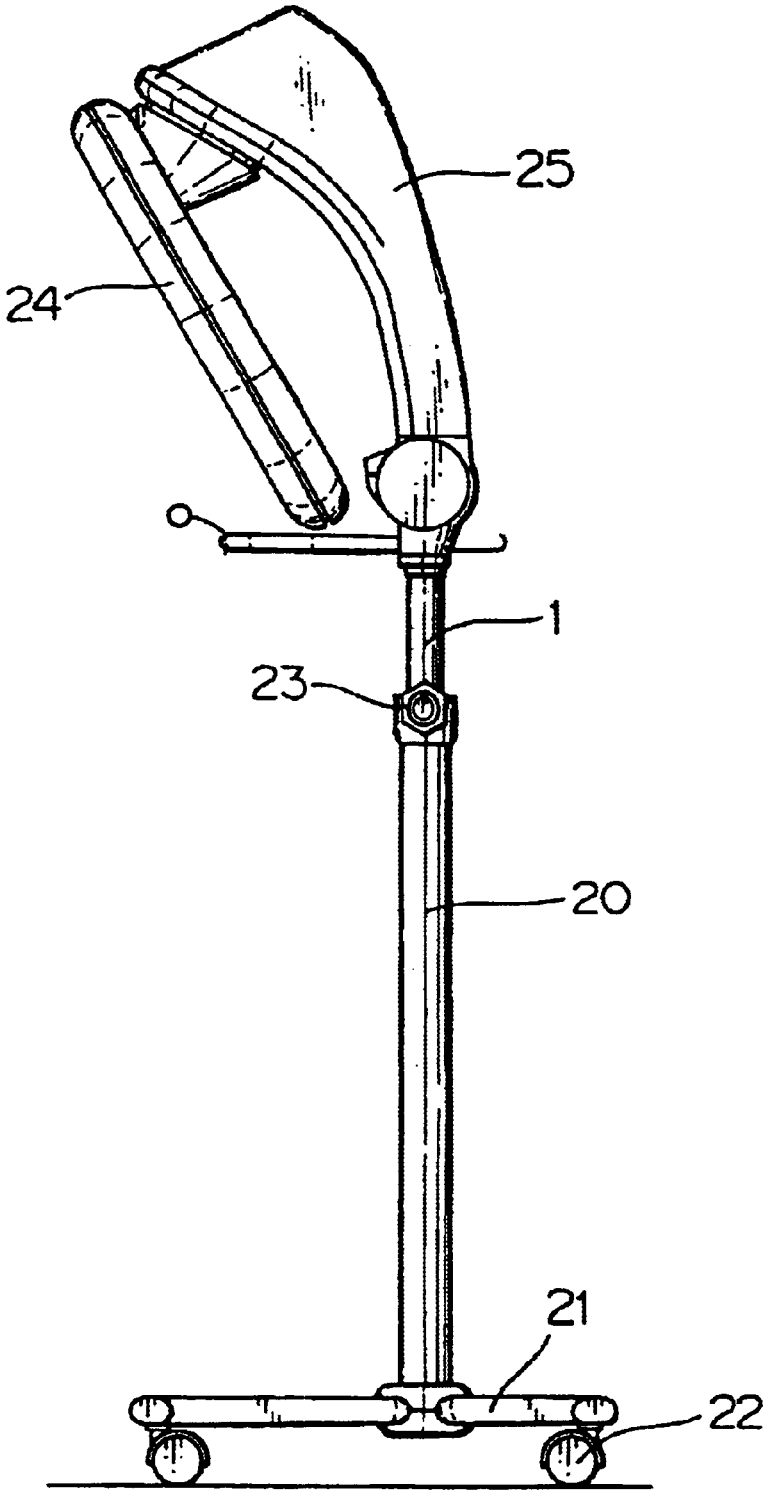
FIG. 25 PRIOR ART
FIG. 25 is a side view of the state where a conventional hair treatment promoting device is attached to a moving stand.
Figure 26:
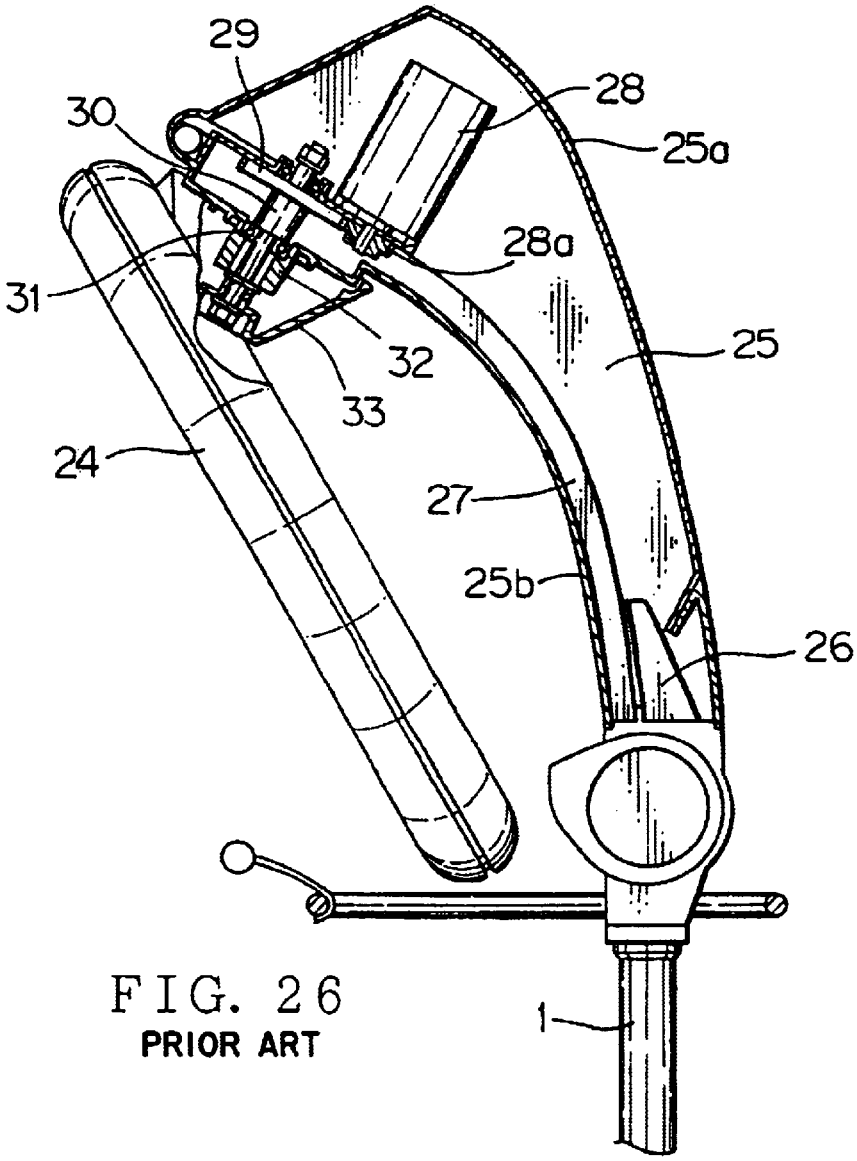
FIG. 26 PRIOR ART
FIG. 26 is a sectional view of a conventional hair treatment promoting apparatus.
Figure 27:
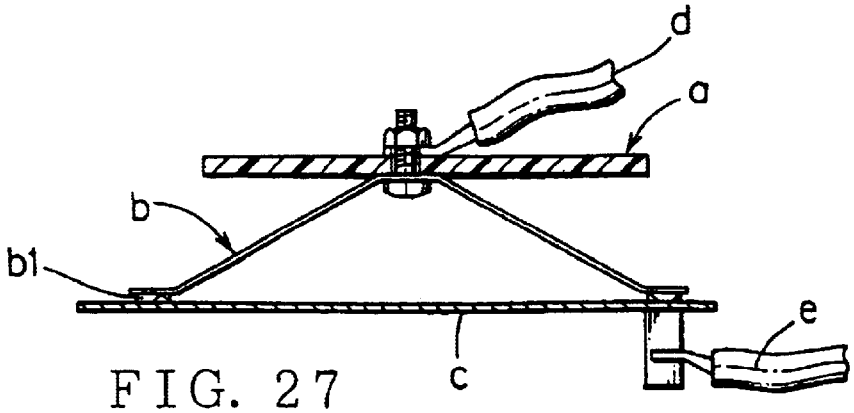
FIG. 27 PRIOR ART
FIG. 27 is a sectional view of another conventional hair treatment promoting device having a rotary power-feeding device.

Reference numeral 112 denotes a disk with a plurality of slits 112*a*1–112*a*6 formed on the outer periphery as shown in FIG. 24. The slit 112*a*1 is a wide slit for a home position. The slits 112*a*2 and 112*a*3 are narrow slits for stopping which are formed at an interval of 10° leftward and rightward from the slit 112*a*1. The slits 112*a*4 and 112*a*5 are slits for sensing formed at an interval of 45° from the slits 112*a*2 and 112*a*3. The slit 112*a*6 is a slit for setting a swing operation angle formed at an interval of 180° from the slit 112*a*1. Reference numeral 112*b* denotes a photo-coupler for detecting the slits 112*a*1 to 112*a*6.

In FIG. 21, reference numeral 113 denotes an operation switch (not shown) for mode setting which is attached to the sloping surface or vertical surface of the case body 102; 114 denotes a CPU for the control plate 111; 115 denotes a RAM connected to the CPU 114; 116 denotes a ROM connected to the CPU 115; 117 denotes an EEPROM connected to the CPU 114.

An explanation will be given of the operation of the hair treatment promoting apparatus having the configuration described above. When the apparatus is shipped from a factory, various modes which are standard operating conditions have been already stored in the ROM 115. Where the operation for a subject is carried out under a standard operating condition, one of the modes is selected by the operation switch 113.

Figure 22:
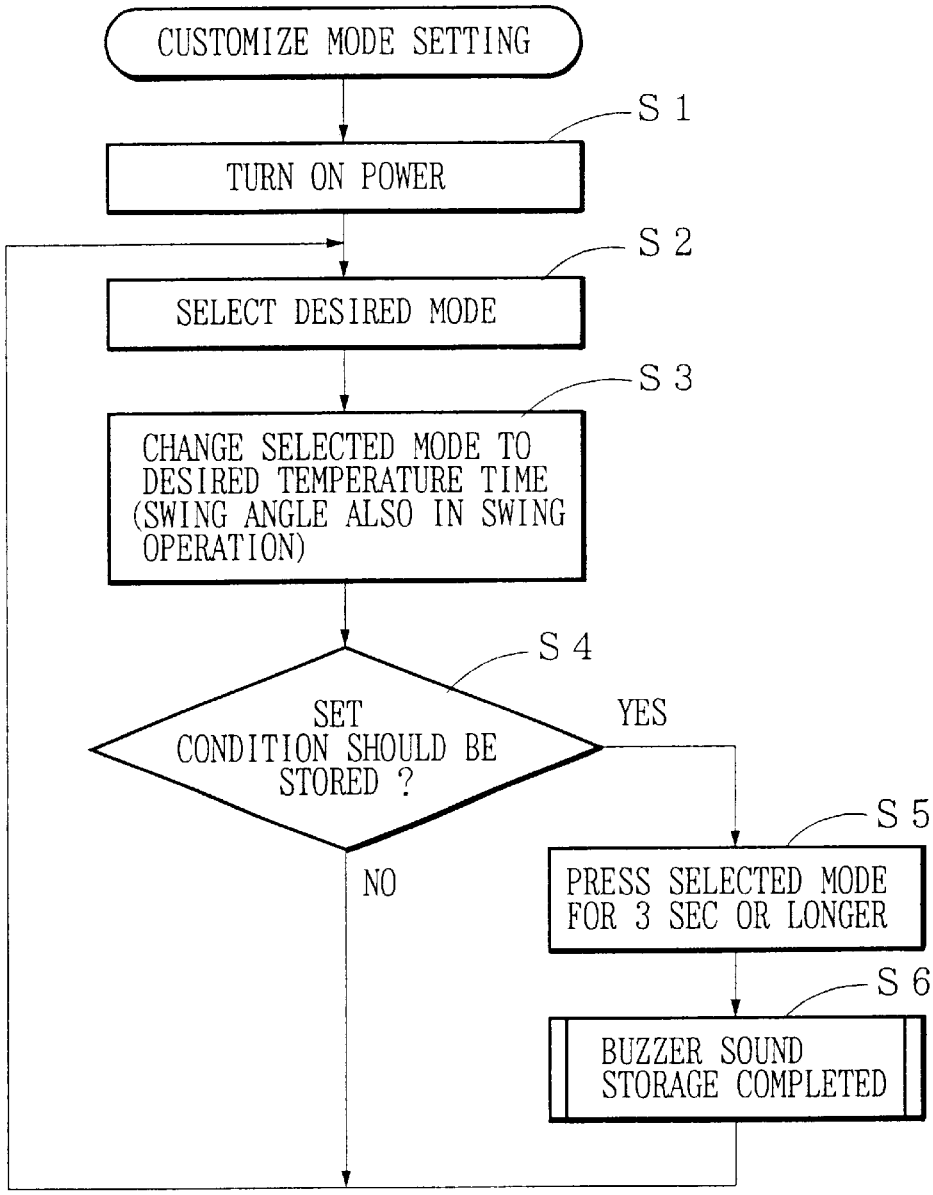
FIG. 22 is a flowchart showing the procedure of mode setting according to this invention.

If the operator decides that the operation cannot be executed under the predetermined modes in view of the contents of the operations and nature of the hair of the subject, along the flowchart of FIG. 22, the contents of the operation will be registered in the EEPROM 117 which is a non-volatile memory.

First, the power source for the hair treatment promoting apparatus is switched on (step S1). By operating the operation switch 113, the most suitable operating condition is selected from the modes previously stored (step S2). Next, by further operating the operation switch 113 in the selected mode, the temperature level, heating time and swing angle in the swing operation are changed according to the operation contents of the operation, medicine and the nature of the hair of the subject (step S3).

It is decided whether or not the subject hopes that the set condition is stored in the memory (step S4). If it is hoped that the condition is stored in the EEPROM 117, the operator continues to push the mode switch on the operation switch 113 for a prescribed time (step S5). When the set mode has been stored in the EEPROM 117, buzzer sounds to notice that the storage has been completed. Thus, the operating condition the subject hopes can be stored.

Accordingly, the operator can carry out the operation for the subject under the optimum operating condition selected from a number of operating conditions stored in the EEPROM 117 according to the operation contents and medicine used during the operation, and also is not required to make troublesome settings.

An explanation will be given of a countermeasure for the case where the hair treatment promoting apparatus tilts or stumbles because of any cause.

Now it is assumed that the hair treatment promoting apparatus has tilted over a prescribed angle. In this case, the tilt sensor 111*a* detects this fact to send a signal to the CPU 114. The CPU 114 interrupts energizing of the motor 103 and heater 173.

In this way, even when the hair treatment promoting apparatus stumbles, energization of the motor 103 and heater is interrupted so that no fire breaks out. Even when the operator touches the apparatus to raise it, he will not be wounded because the cover 171 stops.

An explanation will be given of the operation of rotating or stopping the heating device 107, and periodically reversing its rotation.

Conventionally, only energization and interruption for the motor 103 was controlled by a command from a CPU. On the other hand, in this embodiment, at the time of start of rotation of the motor 103 and actuation of the reversing of the rotating direction (swing), energization is carried out for plural periods of the waveform of an AC power applied to the motor 103 and energization is stopped for the subsequent half period or periods fewer than the plural periods. By repeating such an energizing manner at plural times, the shock when the motor starts and stops can be prevented. Thus, the arm attached to the ceiling and the heating device attached to the ascending/descending rod can be prevented from being vibrated.

Figure 23:
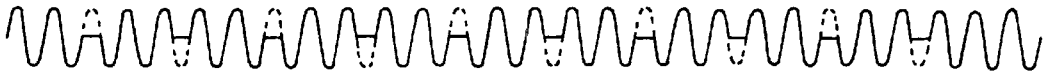
FIG. 23 is a waveform chart of the power supply for preventing the shock while the motor is driven.

Specifically, as shown in FIG. 23, the motor 103 is energized for two cycles of the power frequency at the time of initial power turn-on or reversing and deenergized for the subsequent half cycle. Such an operation is repeated ten times. In this way, the motor can be rotated smoothly for the control from the start of rotation to the above ten times. Thus, the shock when the motor 103 starts to rotate can be reduced.

The motor control can be also executed by controlling a rotation starting switch or a switch for intermittently connecting or disconnecting a resistor connected in series to the motor 103 with the aid of a swing start command signal. Specifically, the resistor is connected in series to the motor 103 for 0.3 sec after the start so that the voltage applied to the motor 103 is reduced to lower the starting torque, thus reducing the starting shock.

In the hair treatment apparatus according to this embodiment, which is provided with the non-contact thermometer 118 and the visible light emitting device 109, the light source 109*a* of the visible light emitting device 109 is lit and set so that the light focused by a lens 109*b* is located at the center of the back of the head of the subject, i.e. the position where the hair's temperature is measured by the non-contact thermometer 118.

Thereafter, the heater 173 and the motor 103 are energized so that the heater 173 heats the hair of the subject at a prescribed temperature while it rotates around the entire head of the subject. Thus, the hair treatment promotion is carried out so that drying of washed hair, promotion of dyeing and permanent waving of the hair can be preferably realized.

In this way, the temperature of the hair of the subject measured by the non-contact thermometer 118 is adjusted. In this case, when the non-contact thermometer 118 suffers breakdown, continuous energization of the heater 173 gives rise to an excessively high temperature. In order to avoid such inconvenience, the following measure is adopted in accordance with this embodiment. Specifically, where the measured temperature does not reach a prescribed temperature after a predetermined time has elapsed, if the non-contact thermometer 118 is out of order cannot detect the predetermined temperature. Therefore, the output signal having a small value from the non-contact thermometer is sent to the CPU 114.

In this embodiment, the CPU 114 monitors the signal from the non-contact thermometer 118. If the output signal from the non-contact thermometer is small, the CPU 114 on/off controls energization of the heater 173 to prevent abnormal heat generation, or interrupts the energization of the heater 173, thereby assuring safety of the hair of the subject against the abnormal heating.

Further, where the above abnormality occurs, an object of which approximate temperature is previously known, e.g. the palm of an operator's hand is caused to approach the front of the non-contact thermometer 118. The temperature acquired from the non-contact thermometer is displayed with the aid of the CPU 114. Thus, it can be easily decided whether the non-contact thermometer 118 is out of order. In this case, only the non-contact thermometer can be repaired by replacement. This avoids waste of replacing the control plate which has been carried out conventionally.

Further, in this embodiment, the disk 112 with the slits 112*a*1 to 112*a*6 as shown in FIG. 24 is rotated synchronously with the rotation of the motor 103 so that the slits 112*a*1 to 112*a*6 are detected by the photo-coupler 112*b*. This permits the heating device 17 to stop all the time at a prescribed home position. This also permits the heating device 107 to swing (reciprocatively rotate) over a prescribed rotary angle. This also permits the non-contact thermometer 108 to take in the temperature at a position not disturbed by the heating device.

An explanation will be given of the operation of stopping the heating device 107 which is rotating at a home position. When the operator performs a stopping operation by the operation switch 113, or a stopping command is issued from the CPU 114 as a result that the time under the prescribed operating mode is reached, the photo-coupler 112 detects the narrow slit 112*a*2 for stopping of the disk 112 (in the case of a clockwise rotation) or the narrow slit 112*a*3 (in the case of a counter-clockwise rotation). In response to-the detection signal, if the slit 112*a*1 is reached within e.g. 0.5 sec, the CPU 114 decides that its position is the home position, and interrupt the energization of the motor 103. Thus, the heating device 107 stops at the home position.

In this embodiment, the slit 112*a*1 is reached by the rotation of 10° (0.5 sec) after the slit 112*a*2 or slit 112*a*3 has been detected so that the heating device stops at the home position.

An explanation will be given of the operation of swinging the heating device 107. As described above, since the heating device 107 detects the home position all the time, in order to define a swing angle, or angle when rotation of the heating device is reversed, the CPU 114 monitors the time after the home position has been passed and when the time has been reached, the direction of energization of the motor 103 is reversed, thereby performing the swing operation. The angle of swing ranges from 20° to 90°.

The non-contact thermometer 118 measures the temperature of the hair at a predetermined position of the subject. In this case, the non-contact thermometer 118 measures the temperature of the cover 171 twice when the heating device 170 rotates once. The temperature of the cover 171 is higher than that of the hair because the cover 171 is supplied with the heat through the reflecting plate 172 from the heater 173. Therefore, the the non-contact thermometer 118 measures the temperature higher than the temperature of the hair as an average value.

In order obviate such an inconvenience, in this embodiment, the CPU 114 takes in the data from the non-contact thermometer 118 when the photo-coupler 112*b* detects the slits 112*a*4, 112*a*5 and 112*a*6 for sensing at the positions where the cover 171 does not pass. These data are adopted for controlling the temperature of the heater 173. Thus, the temperature of the heater can be controlled to follow the prescribed temperature accurately.

In this embodiment, the non-volatile EEPROM 117 was used as a memory. However, a volatile memory may be used with a backup battery for data holding during electric failure.

As described above, in this embodiment, the disk, which rotates synchronously with the motor for rotating the heating device including the heater and reflecting plate, is provided with the slit for the home position and the slits for stopping located on both sides thereof. In operation, energization of the motor is interrupted when the slit for the home position is detected within a prescribed time elapsed from when the slit for stopping is detected in the direction of rotating the heating device, thereby stopping the heating device at the home position. In this way, the heating device can be stopped at the home position accurately when it is rotated reciprocatively. The asymmetrical wear of the rotating portion in the motor gear and rotary power feeding device can be avoided.

The hair treatment promoting apparatus according to this embodiment permits the hair of the subject to be partially heated and the heating device to be rotated reciprocatively within a desired angle. This satisfies the demand of the subject.

Further, in this embodiment, the driving torque of the motor when the motor starts to rotate and reverses its rotating direction is decreased so that the shock at this time reduced. For this reason, the shock can be reduced even when the heating device is subjected to the reversing at desired periods. The operation for the hair based on the swing can be carried out in various manners. In addition, where the heating device is attached to the arm for suspending it from a ceiling, or to a stand equipped with casters, the heating device does not move owing to vibration, thereby making it possible to make appropriate hair treatment promotion.

What is claimed is:

1. A hair treatment promoting apparatus in which a reflecting plate provided with a heater for radiating infrared rays is rotated by a motor so that the infrared rays are radiated to the top, back and both sides of a head of a subject, wherein said heater and said reflecting plate constitute a heating means rotated by said motor and a disk is provided which rotates with said motor, said disk is provided with a slit for a home position and slits for stopping arranged on both sides thereof, and energization of the motor is interrupted when the slit for the home position is detected within a prescribed time elapsed from when the slit for stopping is detected in the direction of rotating the heating device, thereby stopping the heating device at the home position.

2. A hair treatment promoting apparatus according to claim 1, wherein said slit for the home position and said slits for stopping have different widths.

3. A hair treatment promoting apparatus according to claim 1, wherein the energization time of said motor elapsing from when said home position is detected is made variable so that said heating device is rotated within a range of any angle reciprocatively.

* * * * *